US011764052B2

(12) United States Patent
Dziekonski

(10) Patent No.: US 11,764,052 B2
(45) Date of Patent: Sep. 19, 2023

(54) ION INJECTION INTO AN ELECTROSTATIC LINEAR ION TRAP USING ZENO PULSING

(71) Applicant: DH TECHNOLOGIES DEVELOPMENT PTE. LTD., Singapore (SG)

(72) Inventor: Eric Thomas Dziekonski, Richmon Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 267 days.

(21) Appl. No.: 17/312,903

(22) PCT Filed: Dec. 9, 2019

(86) PCT No.: PCT/IB2019/060575

§ 371 (c)(1),
(2) Date: Jun. 10, 2021

(87) PCT Pub. No.: WO2020/121168

PCT Pub. Date: Jun. 18, 2020

(65) Prior Publication Data

US 2022/0051887 A1 Feb. 17, 2022

Related U.S. Application Data

(60) Provisional application No. 62/779,372, filed on Dec. 13, 2018.

(51) Int. Cl.

| | |
|---|---|
| ***H01J 49/42*** | (2006.01) |
| ***H01J 49/00*** | (2006.01) |
| ***H01J 49/48*** | (2006.01) |

(52) U.S. Cl.

CPC ..... *H01J 49/4245* (2013.01); *H01J 49/0031* (2013.01); *H01J 49/426* (2013.01); *H01J 49/482* (2013.01)

(58) Field of Classification Search

CPC .. H01J 49/4245; H01J 49/0031; H01J 49/426; H01J 49/482

(Continued)

(56) References Cited

U.S. PATENT DOCUMENTS

2010/0084549 A1* 4/2010 Ermakov ..... H01J 49/4245 250/293
2013/0270433 A1* 10/2013 Ding ..... H01J 49/0004 250/281
2014/0263992 A1* 9/2014 Ding ..... H01J 49/027 250/252.1

OTHER PUBLICATIONS

International Search Report and Written Opinion for PCT/IB2019/060575, dated Feb. 27, 2020.

(Continued)

*Primary Examiner* — Kiet T Nguyen

(74) *Attorney, Agent, or Firm* — Kasha Law LLC; John R. Kasha; Kelly L. Kasha

(57) ABSTRACT

An ion guide defining a guide axis receives ions. The ion guide applies a potential profile that includes a pseudopotential well to the ions using an ion control field. The ion control field includes a component for restraining movement of the ions normal to the guide axis and a component for controlling the movement of the ions parallel to the guide axis. The ion guide sequentially injects the ions with the same ion energy and in decreasing order of m/z value into an ELIT aligned along an ELIT axis to focus the ions irrespective of m/z value at the same location on the ELIT axis within the ELIT at the same time by varying a magnitude of the pseudopotential well. The ELIT can trap the focused ions using in-trap potential lift or mirror-switching ion capture.

15 Claims, 22 Drawing Sheets

(58) Field of Classification Search
USPC ..... 250/292
See application file for complete search history.

(56) References Cited

OTHER PUBLICATIONS

Eric Dziekonski et al. "Voltage-Induced Frequency Drift Correction in Fourier Transform Electrostatic Linear Ion Trap Miass Spectrometry Using Mirror-Switching," International Journal of Mass Spectrometry., vol. 410, Oct. 25, 2016, pp. 12-21, XP055624637, NL ISSN: 1387-3806.
Loboda A V et al. "A Novel Ion Trap that Enables high Duty Cycle and Wide m/z Range on an Orthogonal Injection TOF Mass Spectrometer," Journal of the American Society for Mass Spectrometry, Elsevier Science Inc., US, vol. 20, No. 7, Jul. 1, 2009, pp. 1342-1348, XP02649940, ISSN: 1044-0305.

* cited by examiner

100

1500

2100

ION INJECTION INTO AN ELECTROSTATIC LINEAR ION TRAP USING ZENO PULSING

RELATED APPLICATIONS

This application claims the benefit of U.S. Provisional Patent Application Ser. No. 62/779,372, filed on Dec. 13, 2018, the content of which is incorporated by reference herein in its entirety.

INTRODUCTION

The teachings herein relate to a system for injecting ions into an electrostatic linear ion trap (ELIT) of a mass spectrometer so that ions with different mass-to-charge ratio (m/z) values are focused at the same location at the same time in the ELIT. More specifically, an ion guide positioned next to an ELIT sequentially injects the ions into the ELIT with the same ion energy and in order of decreasing m/z value to focus all ions irrespective of m/z value at the same location at the same time. This type of sequential injection of ions is referred to as Zeno pulsing.

The systems and methods disclosed herein can be performed in conjunction with a processor, controller, microcontroller, or computer system, such as the computer system of FIG. 1.

ELIT-MS

An electrostatic linear ion trap mass spectrometer (ELIT-MS) is a type of mass spectrometer. An ELIT-MS includes an ELIT for performing mass analysis of ions. In an ELIT, electric current induced by oscillating ions in the trap is detected. The measured frequency of oscillation of the ions is used to calculate the m/z of the ions. For example, a Fourier transform is applied to the measured induced current.

Dziekonski et al., Int. J. Mass Spectrom. 410 (2016) p 12-21, (the "Dziekonski Paper") describes an exemplary ELIT. The Dziekonski Paper is incorporated by reference herein.

FIG. 2 is a three-dimensional cutaway perspective view of an exemplary conventional ELIT 200. ELIT 200 is similar to the ELIT of the Dziekonski Paper. ELIT 200 includes first set of electrode plates 210, pickup electrode 215, and second set of electrode plates 220. First set of electrode plates 120 and second set of electrode plates 220 include holes in the center. Note that the end electrodes of first set of electrode plates 210 and second set of electrode plates 220 do not include holes in the center. However, this is only for simulation purposes. In an actual device, these end electrodes include holes in the center for the introduction and removal of ions from ELIT 200.

In ELIT 200, ions are introduced axially and are typically made to oscillate axially. The ions are made to oscillate axially by appropriately biasing first set of electrode plates 210 and second set of electrode plates 220 to reflect the ions. First set of electrode plates 210 and second set of electrode plates 220 are hereinafter referred to as reflectron plates because they are used to reflect ions.

When operated as a Fourier transform (FT) mass analyzer, pickup electrode 215 is used to measure the induced current, or image charge, produced by the oscillating ions. An FT is applied to the induced current signal measured from pickup electrode 215 to obtain the oscillation frequency. From the oscillation frequency or frequencies, the m/z of one or more ions is calculated.

ELIT Mass Range Limitation

FIG. 3 is an exemplary side view 300 of a system for performing conventional external ion injection into an ELIT. The system of FIG. 3 includes ion injection device 310 and ELIT 320. Injection device 310 includes, for example, a quadrupole 311 followed by a focusing lens 312.

Using a conventional external pulsed ion injection technique, injection device 310 accelerates all ions simultaneously, regardless of m/z. Because all ions are imparted with the same kinetic energy, the lighter ions arrive in ELIT 320 before the heavier ions. For example, ion 301 arrives in ELIT 320 before heavier ion 309.

This time-of-flight (TOF) separation of the injected ions ultimately limits the accepted m/z range of an ELIT. In other words, an increased TOF separation of the ions injected into an ELIT decreases the m/z range that can be measured by the ELIT. Also, TOF separation of injected ions dictates that the size of an ELIT is inversely related to its accepted TOF distance (related to m/z range), ion frequencies, and observed resolution/time, and directly related to the propensity for ion coalescence.

Once ions are trapped in ELIT 320, all plate potentials of ELIT 320 are fixed for the duration of the particular analysis. This means that the trapped ion energy is set via the offset of injection device 310 relative to the offset of ELIT 320. Depending on the way in which ELIT 320 is operated, the offsets may need to be floated to several kV prior to ion injection, which can take tens to hundreds of milliseconds to accomplish. The ramping of the offset potential, therefore, limits the duty cycle to tens of Hertz at maximum. Ions can also be injected by pulsing the trapping potentials of the injection device 310 directly to the injection potentials. This eliminates the need for ramped potentials, potentially increasing the maximum duty cycle, but requires very accurate and reproducible pulses.

FIG. 4 is an exemplary side view 400 of the system of FIG. 3 showing how conventional external ion injection into an ELIT can cause positional dependencies in the measured ion intensity. In FIG. 4, three ion populations of similar m/z 401, 402, and 403 are injected from conventional injection device 310 into ELIT 320 and captured in ELIT 320 via in-trap potential-lift. The TOF separation causes only half of ion population 401 and ion population 403 to be within lift electrode 325 at the moment of capture. The intensity of all three ion populations 401, 402, and 403 cannot simultaneously be maximized. Even ion population 402, which is located within lift electrode 325, would have its kinetic energy distribution affected by in-trap potential-lift due to the non-uniform electric field (electrodes are not gridded). These effects do exist for mirror-switching as well, although the effects are less noticeable considering the larger initial m/z range; only those ions near the extremes of the m/z range would be affected.

As a result, additional systems and methods are needed to inject ions into an ELIT of a mass spectrometer so that ions with different m/z values are focused at the same location at the same time in the ELIT to increase the m/z range of the ELIT and to prevent positional dependencies in the measured ion intensities.

SUMMARY

A system, method, and a computer program product are disclosed for sequentially injecting ions into an ELIT of a mass spectrometer so that ions with different m/z values are focused at the same location at the same time in the ELIT.

The system includes an ion guide and an ELIT. The ELIT includes a pickup electrode, a first set of reflectron plates, and a second set of reflectron plates. Each plate of the first set of reflectron plates includes a hole in the center and is aligned along an ELIT axis. Each plate of the second set of reflectron plates similarly includes a hole in the center and is aligned with the pickup electrode along the ELIT axis.

The ion guide defines a guide axis. The ion guide receives ions along the guide axis from an ion beam of a mass spectrometer. The ion guide applies a potential profile that includes a pseudopotential well to the ions along the guide axis using an ion control field. The ion control field includes a component for restraining movement of the ions normal to the guide axis and a component for controlling the movement of the ions parallel to the guide axis. Finally, the ion guide sequentially injects the ions into the ELIT with the same ion energy and in order of m/z value to focus the ions irrespective of m/z value at the same location on the ELIT axis within the ELIT at the same time by varying the magnitude of the pseudopotential well.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
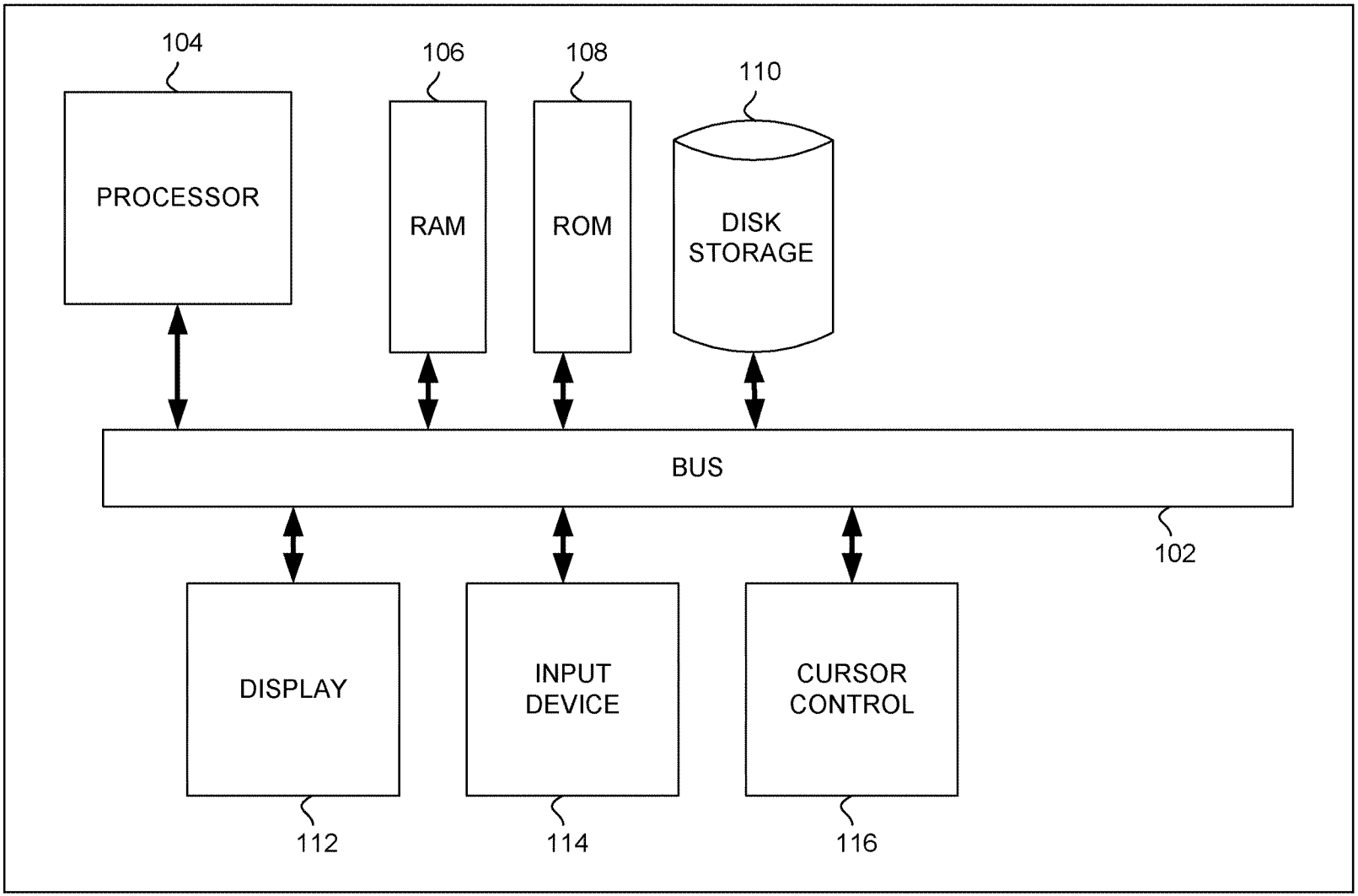
FIG. 1 is a block diagram that illustrates a computer system, upon which embodiments of the present teachings may be implemented.
Figure 2:
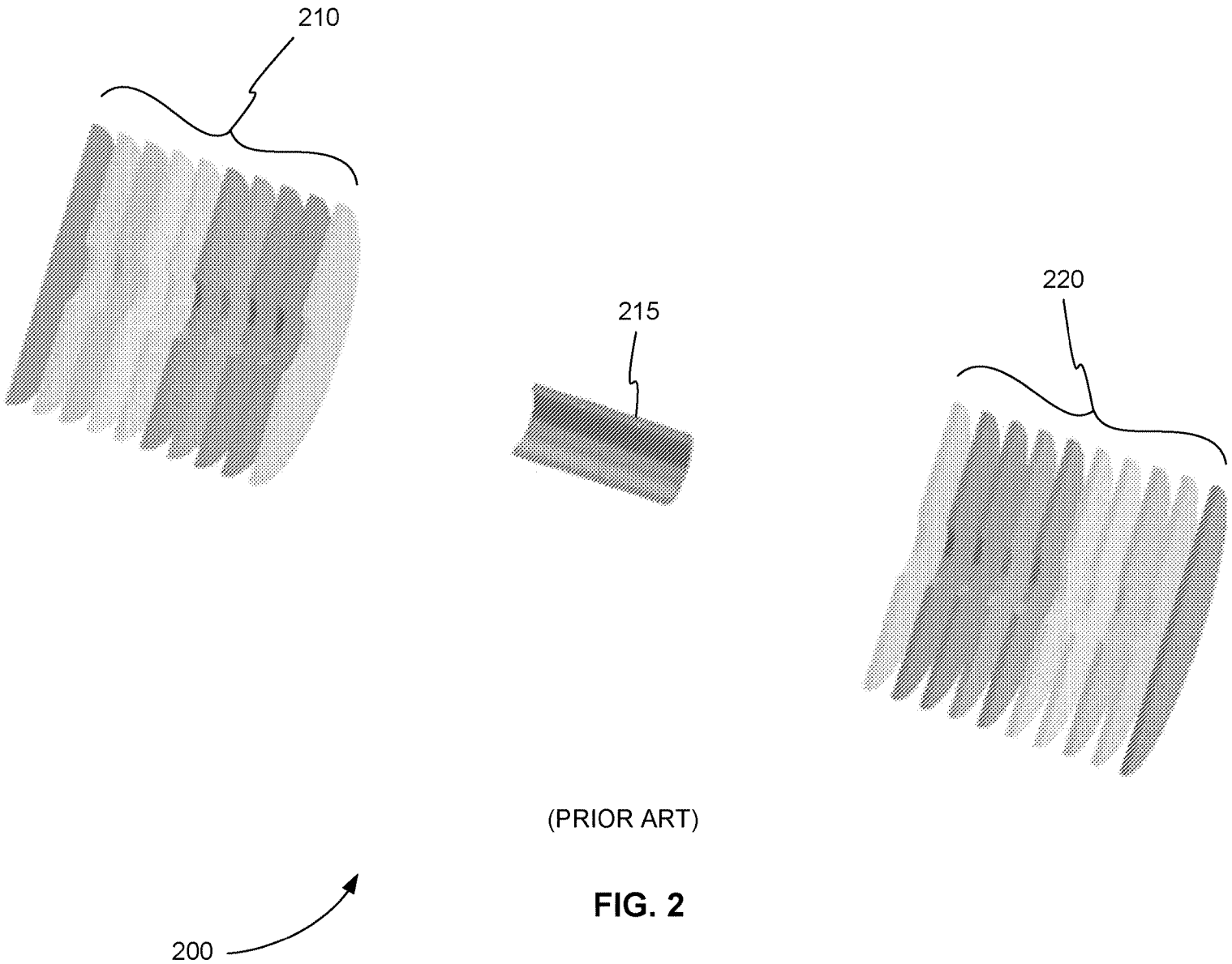
(PRIOR ART) FIG. 2
FIG. 2 is a three-dimensional cutaway perspective view of an exemplary conventional electrostatic linear ion trap (ELIT).
Figure 3:
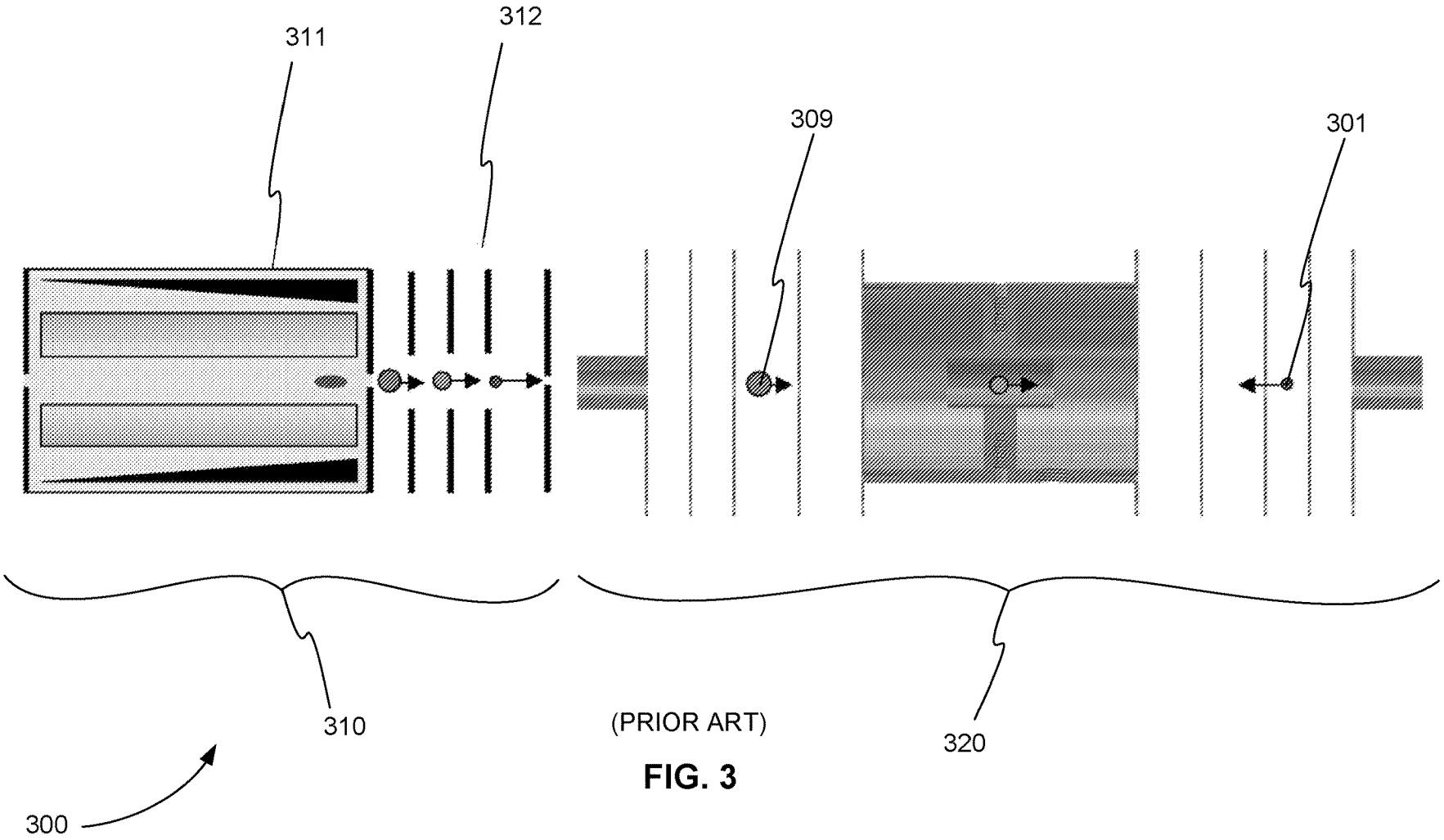
(PRIOR ART) FIG. 3
FIG. 3 is an exemplary side view of a system for performing conventional external ion injection into an ELIT.
Figure 4:
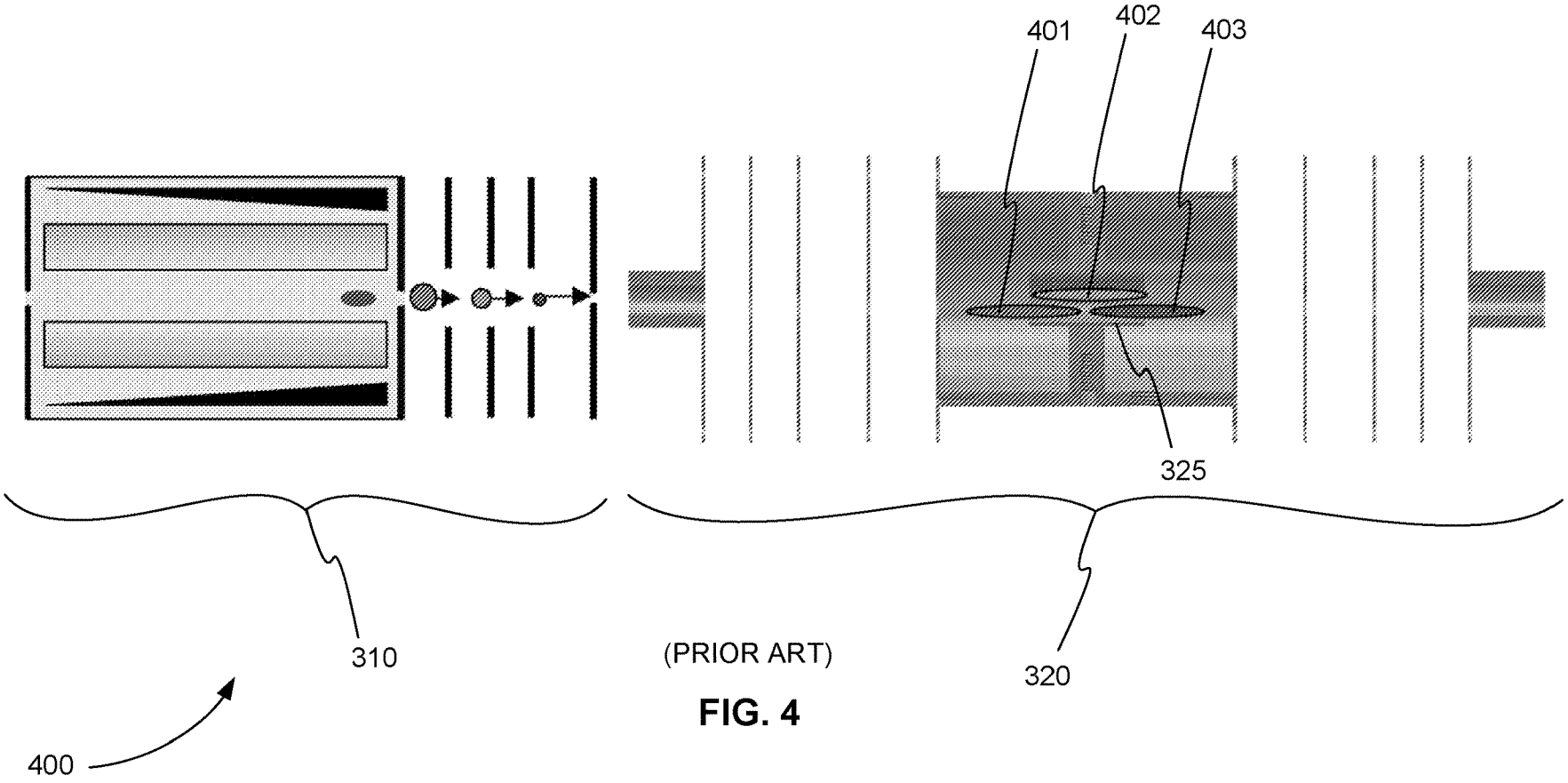
(PRIOR ART) FIG. 4
FIG. 4 is an exemplary side view of the system of FIG. 3 showing how conventional external ion injection into an ELIT can cause positional dependencies in the measured ion intensity.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings. Thus, implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Zeno Pulsed Ion Injection into an ELIT

As described above, conventional external pulsed ion injection into an ELIT accelerates all ions simultaneously, regardless of m/z. This causes TOF separation of the injected ions and ultimately limits the accepted m/z range of an ELIT. This TOF separation can also cause positional dependencies in the ion intensities measured by an ELIT.

As a result, additional systems and methods are needed to inject ions into an ELIT of a mass spectrometer so that ions with different m/z values are focused at the same location at the same time in the ELIT to increase the m/z range of the ELIT and to prevent positional dependencies in the measured ion intensities.

In various embodiments, Zeno pulsing is used to inject ions into an ELIT of a mass spectrometer so that ions with different m/z values are focused at the same location at the same time in the ELIT to increase the m/z range of the ELIT and to prevent positional dependencies in the measured ion intensities.

U.S. Pat. No. 7,456,388 (hereinafter the "'388 Patent") issued on Nov. 25, 2008, and incorporated herein by reference, describes an ion guide that applies Zeno pulsing to orthogonally inject and focus ions with different m/z values at the same location at the same time in a TOF mass analyzer. The '388 Patent provides apparatus and methods that allow, for example, analysis of ions over broad m/z ranges with virtually no transmission losses. The ejection of ions from the ion guide is affected by creating conditions where all ions (regardless of m/z) may be made to arrive at a designated point in space, such as an extraction region or accelerator of a TOF mass analyzer, in a desired sequence or at a desired time and with roughly the same energy. Ions bunched in such a way can then be manipulated as a group, as, for example, by being extracted using a TOF extraction pulse and propelled along a desired path in order to arrive at the same spot on a TOF detector.

To make heavier and lighter ions with the same energy meet at a point in space such as the extraction region of a mass analyzer at substantially the same time, heavier ions can be ejected from the ion guide before lighter ions. Heavier ions of a given charge travel more slowly in an electromagnetic field than lighter ions of the same charge, and therefore can be made to arrive at the extraction region or other point at the same time as, or at a selected interval with respect to, the lighter ions if released within a field in a desired sequence. The '388 Patent provides mass-correlated ejection of ions from the ion guide in a desired sequence.

Figure 5:
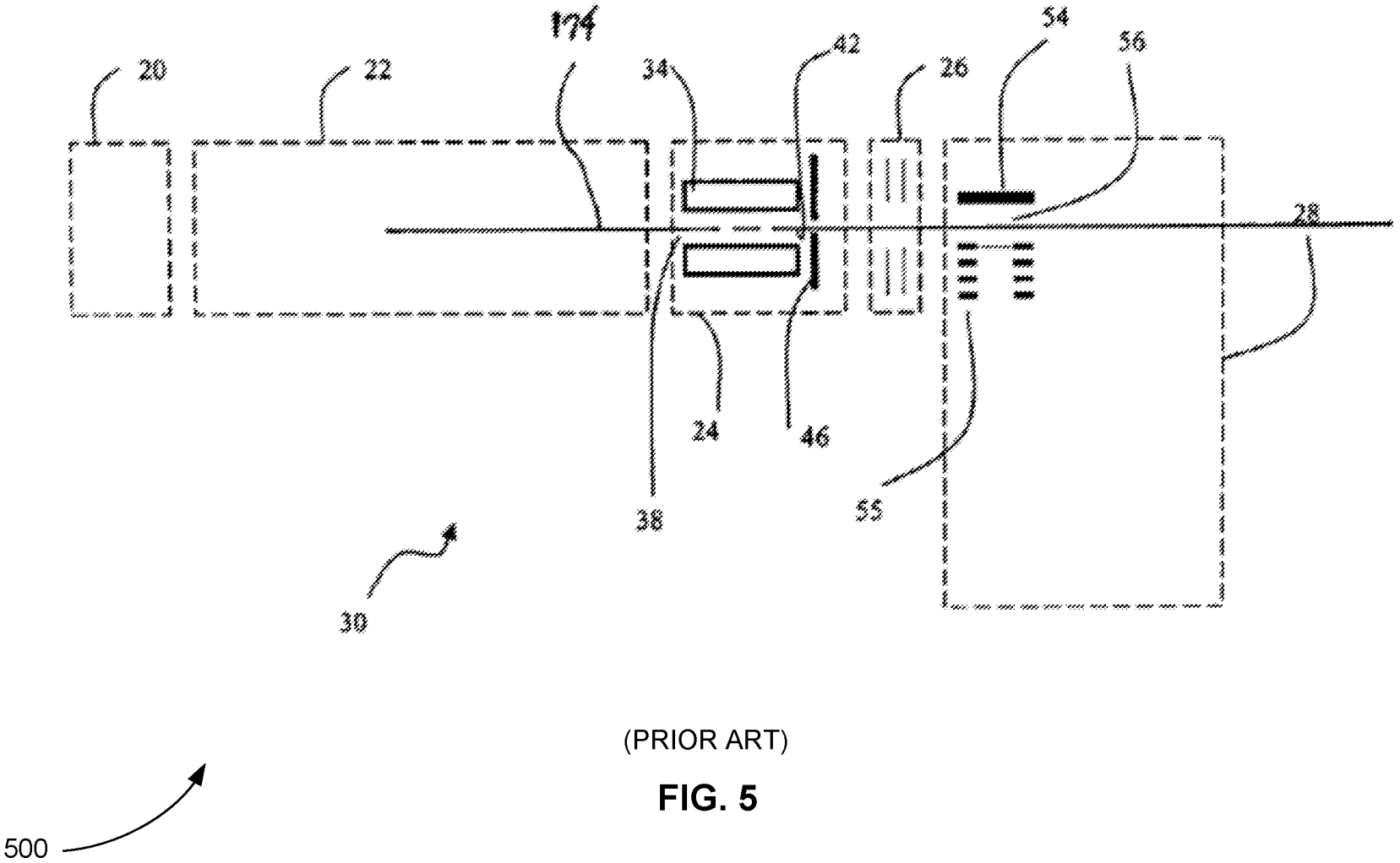
(PRIOR ART) FIG. 5
FIG. 5 is an exemplary schematic diagram of the mass spectrometer described in U.S. Pat. No. 7,456,388.

FIG. 5 is an exemplary schematic diagram 500 of the mass spectrometer described in the '388 Patent. Apparatus 30 comprises a mass spectrometer including ion source 20, ion guide 24, and TOF mass analyzer 28. Ion source 20 can include any type of source compatible with the purposes described herein, including for example sources which provide ions through electrospray ionization (ESI), matrix-assisted laser desorption ionization (MALDI), ion bombardment, application of electrostatic fields (e.g., field ionization and field desorption), chemical ionization, etc.

Ions from ion source 20 may be passed into an ion manipulation region 22, where ions can be subjected to ion beam focusing, ion selection, ion ejection, ion fragmentation, ion trapping, or any other generally known forms of ion analysis, ion chemistry reaction, ion trapping or ion transmission. Ions so manipulated can exit the manipulation region 22 and pass into an ion guide indicated by 24.

Ion guide 24 defines axis 174 and comprises inlet 38, exit 42 and exit aperture 46. Ion guide 24 is adapted to generate or otherwise provide an ion control field comprising a component for restraining movement of ions in directions normal to the guide axis and a component for controlling the movement of ions parallel to the guide axis.

Ion guide 24 may include multiple sections or portions and/or auxiliary electrodes. As will be explained in greater detail below, ion guide 24 of spectrometer 30 is operable to eject ions of different masses and/or m/z ratios from exit 42, while maintaining radial confinement along axis 174 within and beyond the ion guide 24, such that the ions arrive at a desired point substantially along the axis of the ion guide, or in a desired proximity thereto, such as within extraction region 56 of TOF mass analyzer 28, adjacent to push plate 54, at substantially the same time, or in a desired sequence.

Ions ejected from ion guide 24 can be focused or otherwise processed by further apparatus, as, for example, electrostatic lens 26 (which may be considered a part of guide 24) and/or mass analyzer 28. Spectrometer 30 can also include devices such as push plate 54 and accelerating column 55, which may, for example, be part of an extraction mechanism of mass analyzer 28.

Figure 6:
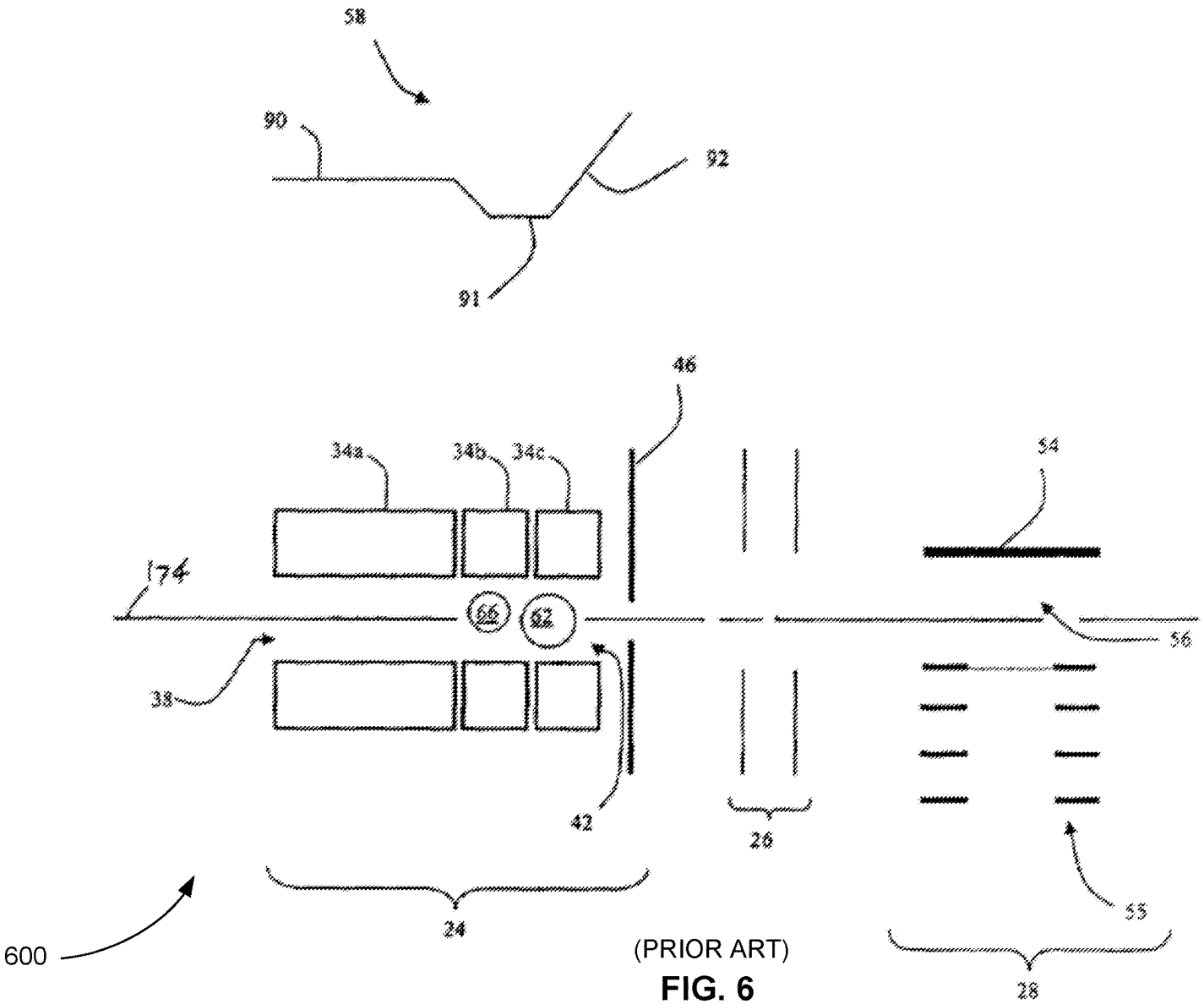
(PRIOR ART) FIG. 6
FIG. 6 is an exemplary schematic diagram of the ion guide, electrostatic lens, and mass analyzer of U.S. Pat. No. 7,456,388 along with an accumulation potential profile of the ion guide.

FIG. 6 is an exemplary schematic diagram 600 of the ion guide, electrostatic lens, and mass analyzer of the '388 Patent along with an accumulation potential profile of the ion guide. Accumulation potential profile 58 of FIG. 6 represents relative potential values, such as voltages or pressures, provided along axis 174 of ion guide 24. The relative potential at portion 34*a* of ion guide 24 is indicated at 90, the potential provided at portions 34*b* and 34*c* at 91, and the potential gradient provided across portion 34*c* of the ion guide 24 and exit 42 of aperture 46 at 92. Although not shown, an RF voltage is applied to ion guide 24 for providing confinement of the ions in the radial direction. Thus, an ion control field comprising a component for restraining movement of ions in directions normal to the guide axis and a component for controlling the movement of ions parallel to the guide axis is provided in ion guide 24.

Provision of an accumulation potential 58 such as that shown in FIG. 6 within ion guide 24 allows large ions 62 (i.e., ions having large m/z values) and small ions 66 (i.e., ions having small m/z values) to traverse ion guide 24 in a direction parallel to axis 174 and settle into the preferential region proximate to electrodes 34*b* and 34*c* provided by the low potential at 91, but prevents them from exiting the ion guide 24 by providing a higher potential on the aperture 46. As will be familiar to those skilled in the relevant arts, it may be beneficial in some circumstances to apply a DC offset voltage on ion guide 24 in addition to the DC voltage mentioned above. In that instance, the overall potential profile 58 would be elevated by the corresponding DC offset voltage.

Figure 7:
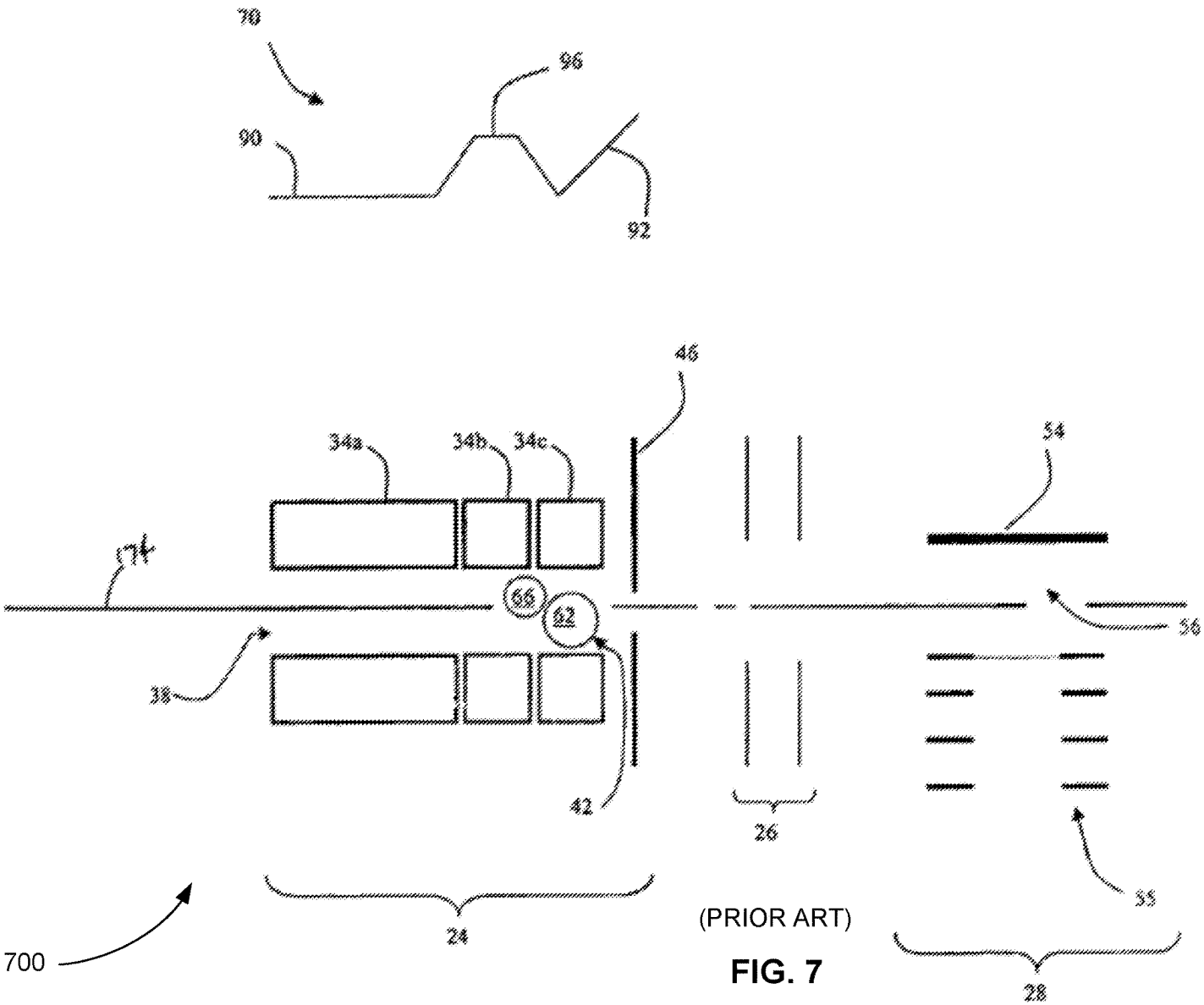
(PRIOR ART) FIG. 7
FIG. 7 is an exemplary schematic diagram of the ion guide, electrostatic lens, and mass analyzer of U.S. Pat. No. 7,456,388 along with a pre-ejection potential profile of the ion guide.

FIG. 7 is an exemplary schematic diagram 700 of the ion guide, electrostatic lens, and mass analyzer of the '388 Patent along with a pre-ejection potential profile of the ion guide. Pre-ejection potential profile 70 of FIG. 7 represents relative potential values, such as voltages or pressures, provided along axis 174 of ion guide 24. In the example shown in FIG. 7, pre-ejection profile 70 is similar to that described for accumulation potential profile 58 of FIG. 6, but with potential 91 replaced by potential 96 at portion 34*b* of the ion guide 24 and corresponding changes in potential gradient 92. Thus, a modified ion control field comprising a component for restraining movement of ions in directions normal to the guide axis and a component for controlling the movement of ions parallel to the guide axis is provided in ion guide 24.

Provision of a pre-ejection profile 70 such as that shown in FIG. 7 can, for example, be used to cause ions 62 of relatively larger m/z and ions 66 of relatively smaller m/z to move within ion guide 24 in a direction parallel to axis 174 and settle within the region of ion guide 24 between portion 34*b* of the guide and aperture 46. The potential at 96 can also prevent additional ions from entering ion guide 24 to a point beyond portion 34*b*.

Figure 8:
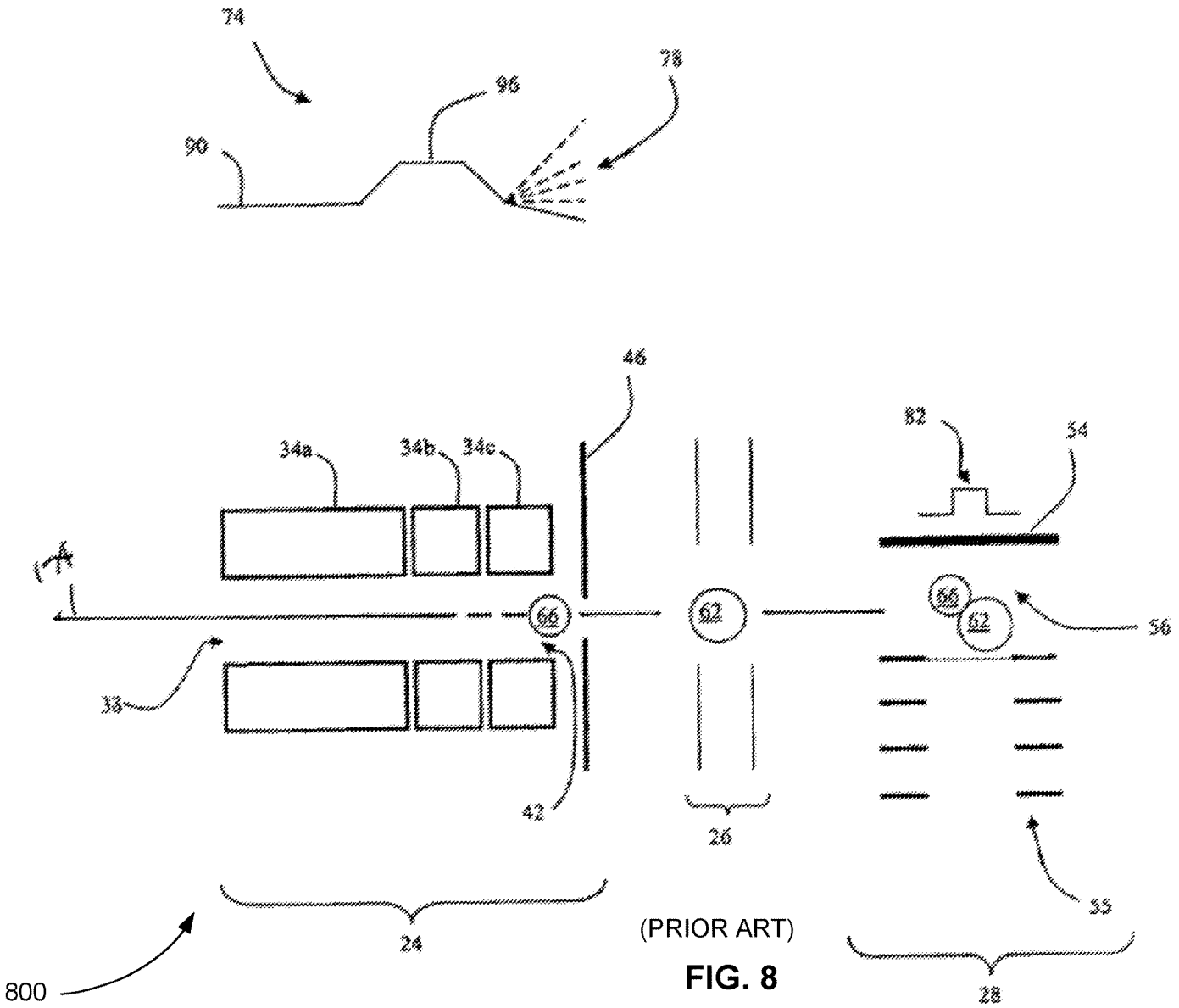
(PRIOR ART) FIG. 8
FIG. 8 is an exemplary schematic diagram of the ion guide, electrostatic lens, and mass analyzer of U.S. Pat. No. 7,456,388 along with an ejection potential profile of the ion guide.

FIG. 8 is an exemplary schematic diagram 800 of the ion guide, electrostatic lens, and mass analyzer of the '388 Patent along with an ejection potential profile of the ion guide. Ejection potential profile 74 of FIG. 8 can be created by, for example, applying an alternating current ("AC") voltage within portion 34*c* of ion guide 24 and/or at an exit aperture 46, superimposed on voltages otherwise applied to the ion guide 24. For example, appropriate RF and DC potentials may be applied to opposed pairs of electrodes within an ion guide 24, along with suitable DC offset voltages applied to various sets of electrodes. The AC voltage can, for example, be superimposed over the RF voltage, while a difference between a potential at portion 34*c* and a potential at exit aperture 46 is reduced.

Ejection potential profile 74 along the axis of guide 24 can be provided by, for example, using a pseudopotential such as that represented by dashed lines at reference 78 in FIG. 8.

For example, at the beginning of an ejection cycle such as cycle 74 represented in FIG. 8, the magnitude or depth of a pseudopotential 78 may be chosen so that ions 62 of larger m/z ratios will leave exit 42 first. As the larger m/z ions 62 are released, the amplitude of the AC voltage may be gradually reduced to change the depth of the pseudopotential 78 well, and after a desired delay, to allow ions 66 of smaller m/z to leave ion guide 24. The delay may be determined by controlling the rate of change of the AC amplitude, and may, for example, be chosen based on the masses and/or m/z ratios of ions 62 and 66 to achieve a desired delay. In the situation shown in FIG. 8, ions 66 of smaller m/z travel faster than the ions 62 of larger m/z and gradient 78 is set accordingly. Gradient 78 is used to describe a variation of some parameter in space, but not in time.

Ions are provided to a desired point in space 56 disposed on, or substantially along, guide axis 174, as for example an extraction region in a TOF analyzer for detection and mass analysis using methods generally known in the art. This is represented at the right-hand portion of FIG. 8, where the different rates of travel of ions 62 and 66 have resulted in ions 62 and 66 reaching the orthogonal extraction region 56 in front of push plate 54, at substantially the same time. At this point, an extraction pulse 82 may be applied to push plate 54 to pulse ions 62, 66 through the accelerating column 55.

As shown in FIGS. 5 through 8, the '388 Patent describes performing Zeno pulsing in conjunction with TOF mass analyzer 28. Zeno pulsing has also been used in conjunction with a Fourier-transform ion cyclotron resonance (FT-ICR) mass analyzer. Both of these instruments can use low-energy ion transfer conditions from the ion guide to the mass analyzer. In contrast, on an instrument using an ELIT, ions are transported through high electric fields, with kinetic energies on the order of thousands of electron-volts, making it not obvious that Zeno pulsing could be coupled to an ELIT device given the extremely long effective flight length.

In Zeno pulsing, the AC ramp time is chosen to bring the ions to a focus at an effective flight length, L. The slower the ramp down time, the longer the effective distance between the ion guide and focal point. However, the slower the AC ramp, the longer it takes ions to be released from the ion guide, thereby generating a longer the packet length at the focal point.

For orthogonal acceleration TOF mass spectrometers, an AC ramp (100-200 μs) will give an effective flight length of about 10 cm, with a packet width of around 5 cm, which is perfectly fine considering the size of the detector. For the signal induced on the image current/charge detector in an ELIT to be maximized, the ion packet must be shorter than the pickup electrode. For smaller ELITs, this would mean that the ion packet should be around 1 cm or less, with a mechanical focal length of 10-12 cm. As ion acceleration is performed on the way to the ELIT from the ion guide, high potentials are located in the intermediate transfer lenses. These high potentials increase the ion velocity, lowering the amount of time that the ions spread within the region, thereby greatly increasing the effective distance to the focal point (equivalent to a very large mechanical focal length).

For Zeno pulsing to be implemented on an ELIT, the effective focal distance and packet length must be reduced, both of which can be accomplished through a drastic reduction in the AC ramp down time (<10 us). Electrically, this comes with its own set of challenges as fast AC ramps require significantly more power and can compromise the linearity of the ramp. Still, depending on the magnitude of the intermediate potentials, it may not be possible to electronically reduce the effective focal distance enough, in which case only option is to move the ELIT further away from the ion guide. This negatively affects the mechanical tolerances of parts, alignment, cost, etc. In various embodiments, it is possible to bunch the ion packet closer to the exit lens in the ion guide using auxiliary electrodes, which decrease the downstream packet width without needing a faster AC ramp.

As described above, in Zeno pulsing, ions are released in order of high m/z to low m/z. This causes all ions, regardless of m/z, to come to a focus at a distance determined by the AC ramp time and electrode potentials. In various embodiments, when this focus is made to be within the lift electrode (in-trap potential-lift) or somewhere within the outermost electrodes of the ELIT (mirror-switching), the m/z range of the ELIT is maximized. In a preferred embodiment, the focus is made to coincide with the center of the ELIT.

When all ions of different m/z values come to a focus within the ELIT upon injection, the axial dimension of the ELIT becomes decoupled from the accepted TOF distance and m/z range. In various embodiments, therefore, the ELIT can be made shorter, thereby maximizing the ion frequencies, resolution/time, and minimizing coalescence effects. In addition, by moving the Einzel potential to the central element of the ELIT, and getting rid of two electrodes, the trap dimensions can be reduced even further. All things considered, the ion frequencies in a miniature ELIT could rival those found in the high-field Orbitrap.

Figure 9:
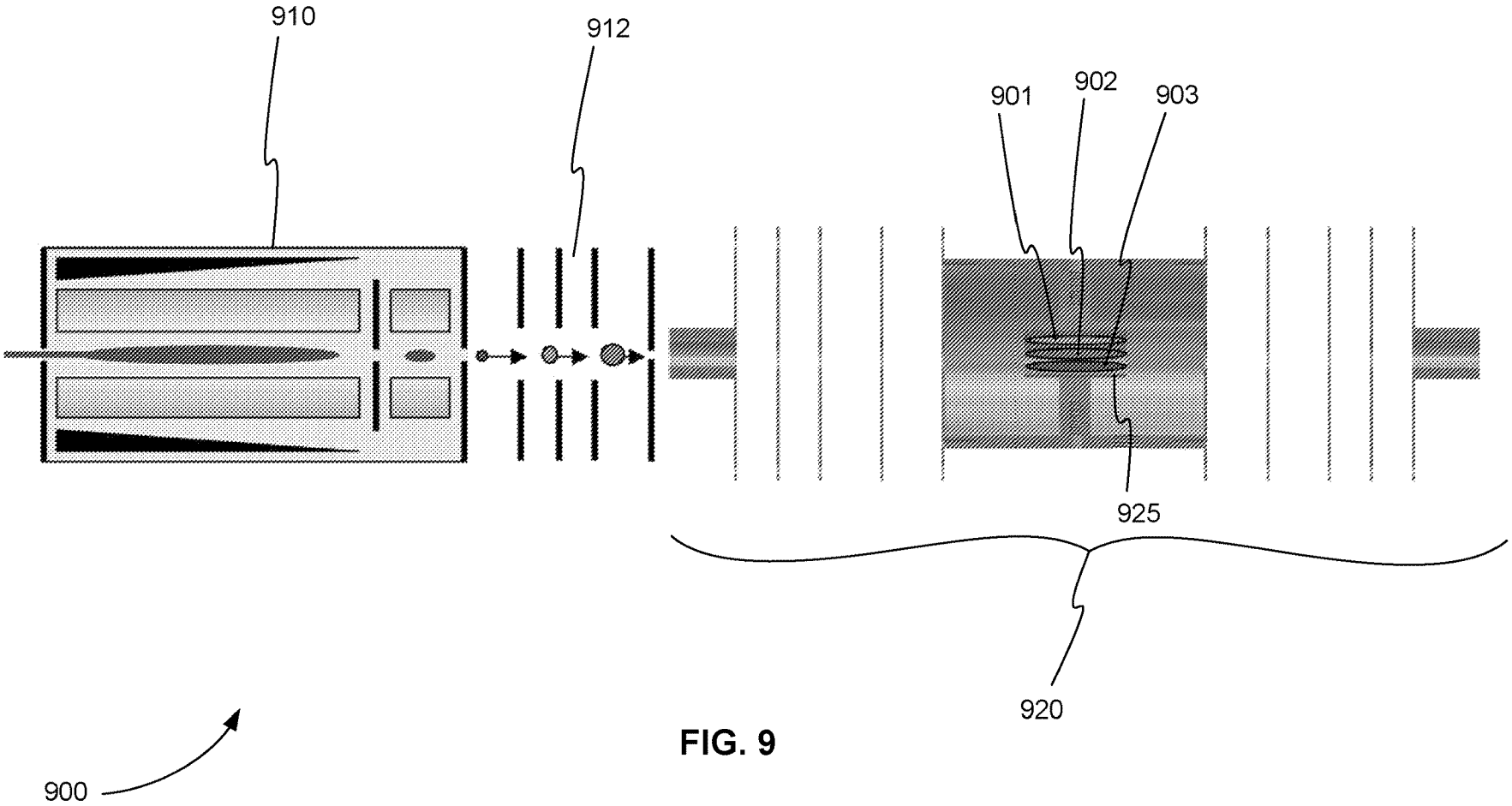
FIG. 9 is an exemplary side view of an ion guide sequentially injecting ions in order of decreasing m/z into an ELIT showing how this type of ion injection additionally minimizes aberrations in ion intensity due to positional dependencies of the ion clouds at the moment of capture, in accordance with various embodiments.

FIG. 9 is an exemplary side view 900 of an ion guide sequentially injecting ions in order of decreasing m/z into an ELIT showing how this type of ion injection additionally minimizes aberrations in ion intensity due to positional dependencies of the ion clouds at the moment of capture, in accordance with various embodiments. In FIG. 9, ion guide 910 sequentially injects ions in order of decreasing m/z into ELIT 920 and focuses the ions in the same location at the same time irrespective of m/z value using Zeno pulsing. Ions ejected from ion guide 910 can be focused or otherwise processed by further apparatus, as, for example, electrostatic lens 912 (which may be considered a part of guide 910). Focusing the ions in the same location at the same time irrespective of m/z value using Zeno pulsing increases the m/z range of ELIT 920.

It also, however, minimizes aberrations in ion intensity due to positional dependencies of the ion clouds at the moment of capture. For example, if three ion populations of similar m/z 901, 902, and 903 are injected from ion guide 910 into ELIT 920 via in-trap potential-lift, the Zeno pulsing causes all three ion populations 901, 902, and 903 to be within lift electrode 925 at the moment of capture. As all ion populations or clouds 901, 902, and 903 are overlapping in lift electrode 925, all ion intensity measurements suffer equally, so there is no positional dependency in these measurements. The kinetic energy distribution of all ion populations 901, 902, and 903 would also be affected in the same way by the lift action, allowing the trapping potentials of ELIT 920 to be tuned to minimize the resulting TOF aberrations.

In various embodiments, using in-trap potential-lift, the trapped ion kinetic energy is decoupled from ion guide 910. Therefore, ion guide 910 can be operated at about ground potential and ELIT 920 can be floated (negative for positive ion analysis, and vice versa). As no offsets need to be ramped, the duty cycle of the experiment can be increased such that it is ultimately limited by the rate at which ions cool and length of time the AC takes to ramp down (>1 kHz).

Unfortunately, if ion guide 910 is operated at about ground, lift electrode 925 needs to be pulsed to a high voltage to capture the ions. This requires a power supply with an extremely fast feedback loop and transient voltage recovery. Also, if lift electrode 925 coincides with the pickup detector, it is necessary to shield (protect, turn off) the preamplifier during the pulse. In various embodiments, it is possible to utilize two pulsed elements, one in the transfer lenses and one in ELIT 920, to capture ions via in-trap potential-lift. Zeno pulsing would be used to focus all ions in the first pulsed electrode, wherein the potential would be pulsed higher than the trapping potentials of ELIT 920. Ions can then enter ELIT 920 and be captured by pulsing the lift electrode to ground. This configuration allows ion guide 910 to be operated about ground and for lift electrode 925 to be pulsed to ground, minimizing voltage perturbations. Unfortunately, there will still be a TOF separation of the ions between the first pulsed electrode and ELIT 920, thereby limiting the accepted m/z range.

Figure 10:
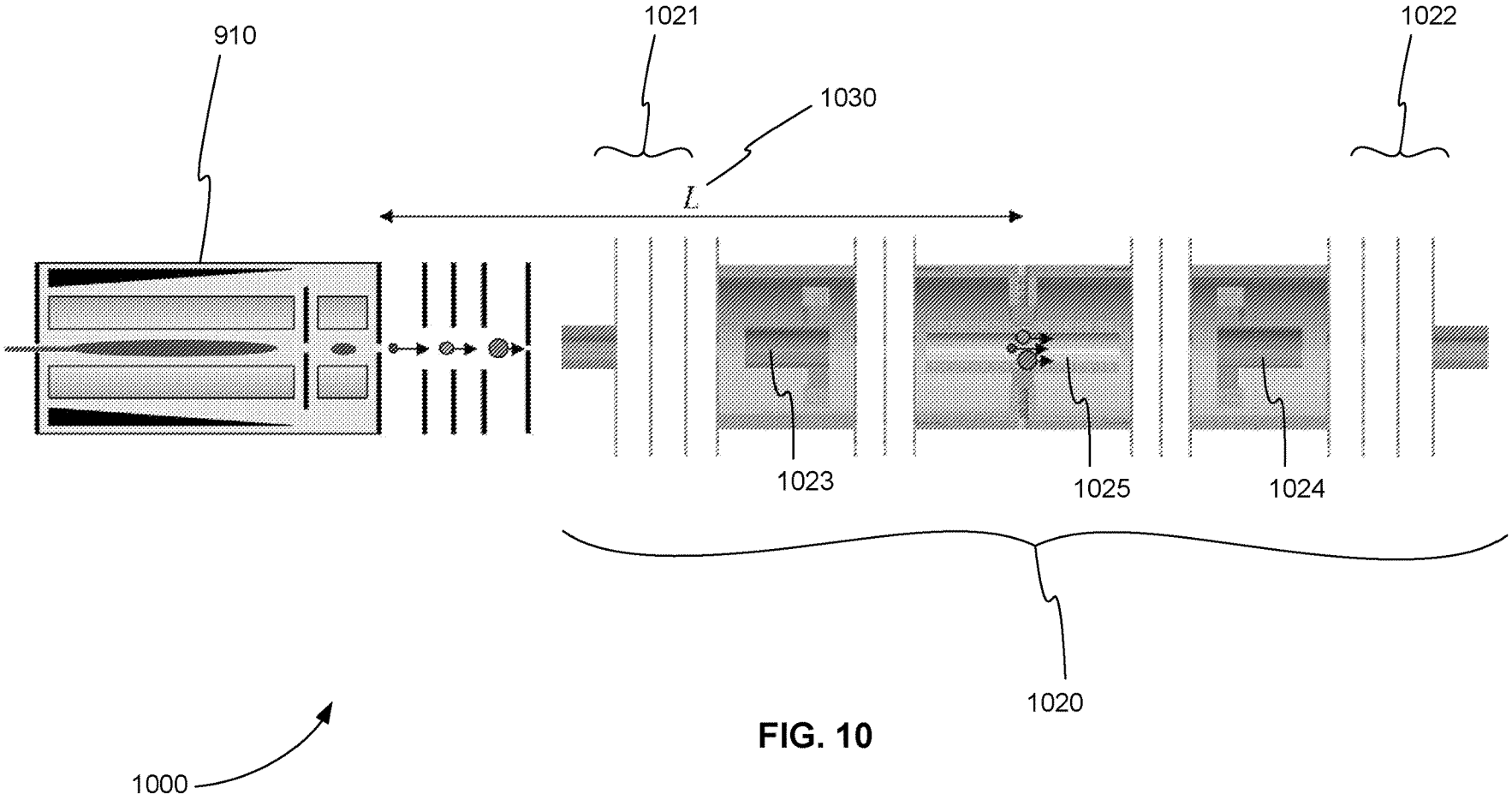
FIG. 10 is an exemplary side view of an ion guide sequentially injecting ions in order of decreasing m/z into a dual detector ELIT with a separate lift electrode showing the location of ion focus when the dual detector ELIT is performing in-trap potential lift ion capture, in accordance with various embodiments.

FIG. 10 is an exemplary side view 1000 of an ion guide sequentially injecting ions in order of decreasing m/z into a dual detector ELIT with a separate lift electrode showing the location of ion focus when the dual detector ELIT is performing in-trap potential lift ion capture, in accordance with various embodiments. In FIG. 10, ion guide 910 sequentially injects ions in order of decreasing m/z into dual detector ELIT 1020 and focuses the ions in the same location at the same time irrespective of m/z value using Zeno pulsing.

Dual detector ELIT 1020 is performing in-trap potential lift ion capture in FIG. 10. In in-trap potential lift ion capture, ions are injected with more kinetic energy than the initial potential applied to any of the elements of dual detector ELIT 1020. This means, for example, that, if no voltages are changed, ions coming from ion guide 910 would pass through dual detector ELIT 1020 once and exit the second set of reflectron plates 1022 and be detected by dual pickup detectors 1023 and 1024 for only one pass. In in-trap potential lift ion capture, however, once the ions reach central lift electrode 1025, the potential applied to lift electrode 1025 is rapidly changed. This pulsed potential changes the total energy of the ions such that they are unable to overcome the potential barriers of first set of reflectron plates 1021 and second set of reflectron plates 1022, so they remain trapped in dual detector ELIT 1020.

As a result, in in-trap potential lift ion capture, ions need to be focused within lift electrode 1025. FIG. 10 shows that ions with different m/z values are focused in dual detector ELIT 1020 at the same location at length 1030 from ion guide 910. Ions are preferably focused at the center of lift electrode 1025 as shown in FIG. 10. However, in various alternative embodiments, ions can be focused at any location in lift electrode 1025. Note that in this case ion detection and ion capture are performed on separate electrodes, simplifying the required electronics.

Figure 11:
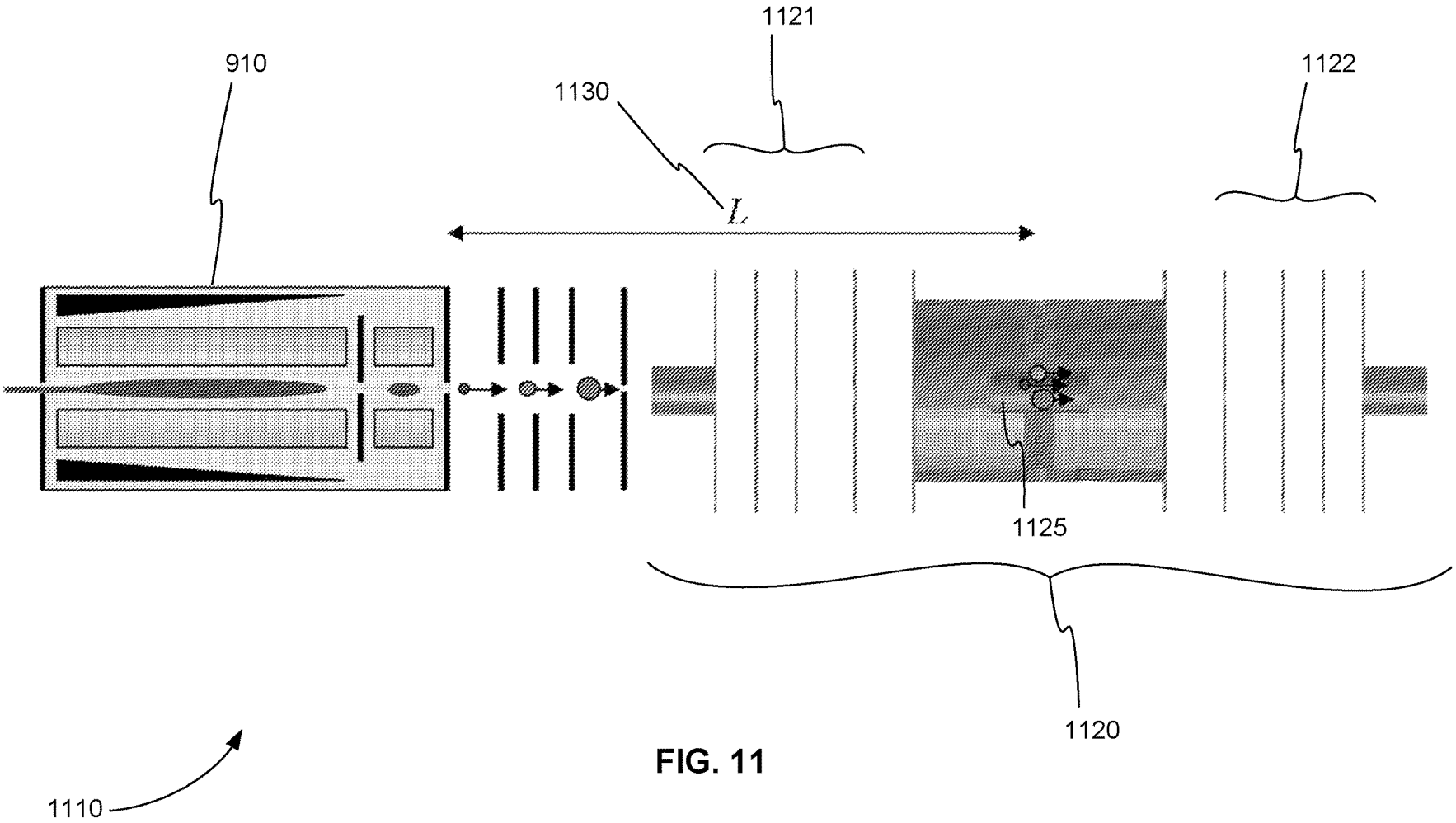
FIG. 11 is an exemplary side view of an ion guide sequentially injecting ions in order of decreasing m/z into a single detector ELIT showing the location of ion focus when the ELIT is performing in-trap potential lift ion capture, in accordance with various embodiments.

FIG. 11 is an exemplary side view 1100 of an ion guide sequentially injecting ions in order of decreasing m/z into a single detector ELIT showing the location of ion focus when the ELIT is performing in-trap potential lift ion capture, in accordance with various embodiments. In FIG. 11, ion guide 910 sequentially injects ions in order of decreasing m/z into single detector ELIT 1120 and focuses the ions in the same location at the same time irrespective of m/z value using Zeno pulsing.

Single detector ELIT 1120 is performing in-trap potential lift ion capture in FIG. 11. Pickup electrode 1125 is used to detect the image current/charge resulting from ions passing through it and is also biased to act as lift electrode. In in-trap potential lift ion capture, once the ions reach central pickup electrode 1125, a potential is applied to pickup electrode 1125. This potential changes the total energy of the ions such that they are unable to overcome the potential barriers of first set of reflectron plates 1121 and second set of reflectron plates 1122, so they remain trapped in single detector ELIT 1120.

FIG. 11 shows that ions with different m/z values are focused in single detector ELIT 1120 at the same location at length 1130 from ion guide 910. Ions are preferably focused at the center of pickup electrode 1125 as shown in FIG. 11. However, in various alternative embodiments, ions can be focused at any location in pickup electrode 1125.

Figure 12:
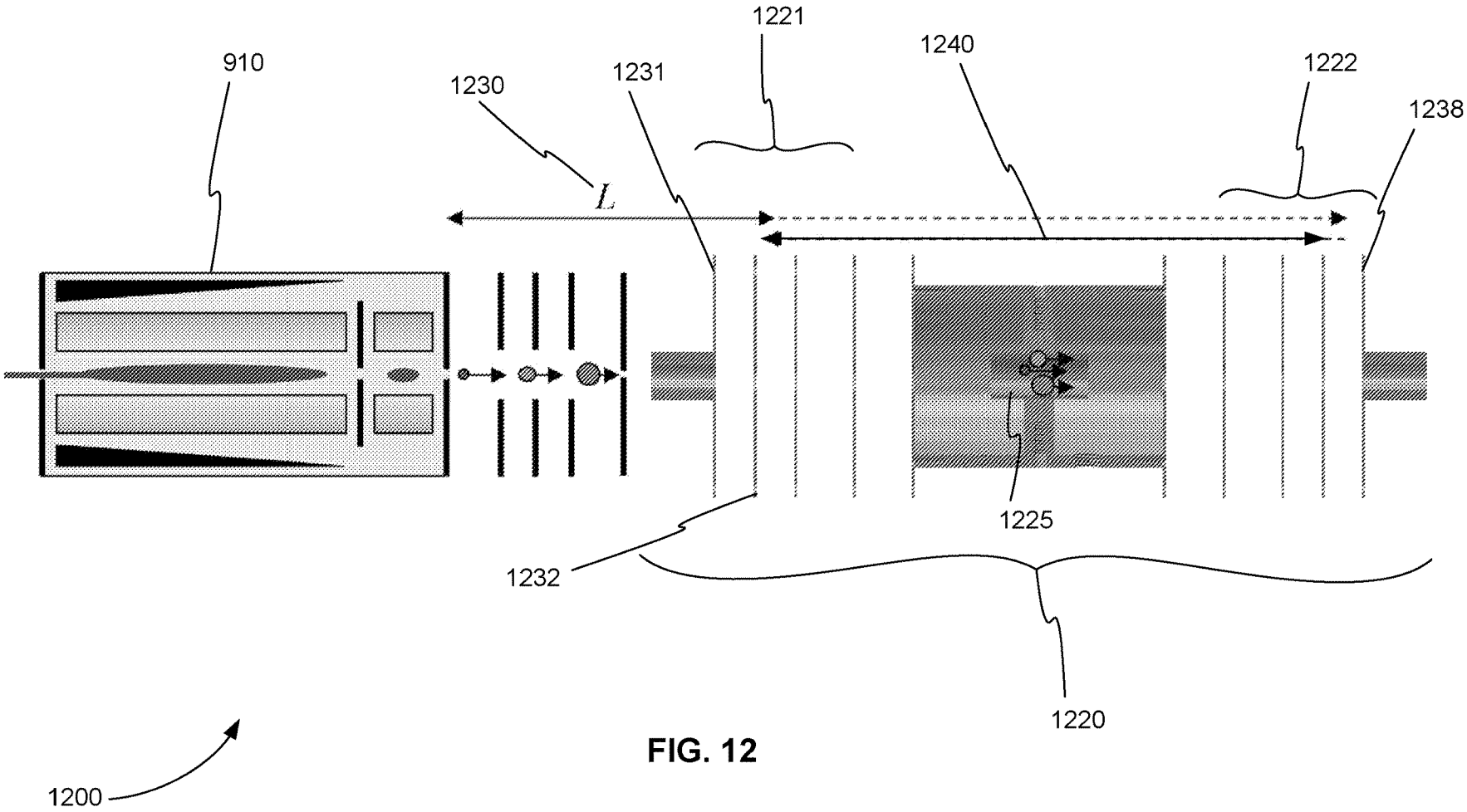
FIG. 12 is an exemplary side view of an ion guide sequentially injecting ions in order of decreasing m/z into an ELIT showing the location of ion focus when the ELIT is performing mirror-switching ion capture, in accordance with various embodiments.

FIG. 12 is an exemplary side view 1200 of an ion guide sequentially injecting ions in order of decreasing m/z into an ELIT showing the location of ion focus when the ELIT is performing mirror-switching ion capture, in accordance with various embodiments. In FIG. 12, ion guide 910 sequentially injects ions in order of decreasing m/z into ELIT 1220 and focuses the ions in the same location at the same time irrespective of m/z value using Zeno pulsing.

ELIT 1120 is performing mirror-switching ion capture in FIG. 12. In mirror-switching, a repulsive potential is applied to outermost reflectron plate 1231 of first set of reflectron plates 1221 and outermost reflectron plate 1238 of second set of reflectron plates 1222. During ion capture, ions are trapped between outermost reflectron plate 1231 and outermost reflectron plate 1238. In various embodiments, additional electrodes could be included in the first set of reflectron plates 1221 and the second set of reflectron plates 1222. Also, in various embodiments, one or more electrode plates in the first set of reflectron plates 1221 and the second set of reflectron plates 1222 could have a repulsive potential applied to it.

During injection, a non-repulsive potential is applied to outermost reflectron plate 1231 allowing ions to enter into ELIT 1220. Once the ions reach the focus location within ELIT 1220, the repulsive potential is again applied to outermost reflectron plate 1231 to trap the ions within ELIT 1220.

Using mirror-switching, the focus location of the Zeno pulse can be virtually anywhere within ELIT 1220, so long as it is not in the vicinity of a switched potential, as this would alter the ion energy. In FIG. 12, only the potential of outermost reflectron plate 1231 is switched. Thus, the focus location point can be anywhere in range 1240 between reflectron plates 1232 and 1238. Ions, therefore, travel a minimum length 1230 from ion guide 910 to the focus location. Still, it is best practice for this focus location to be made at the center of ELIT 1220 in pickup electrode 1225. Note that in the case of mirror-switching, the potential applied to detector 1225 is not pulsed to capture ions, greatly simplifying the detection electronics.

Figure 13:
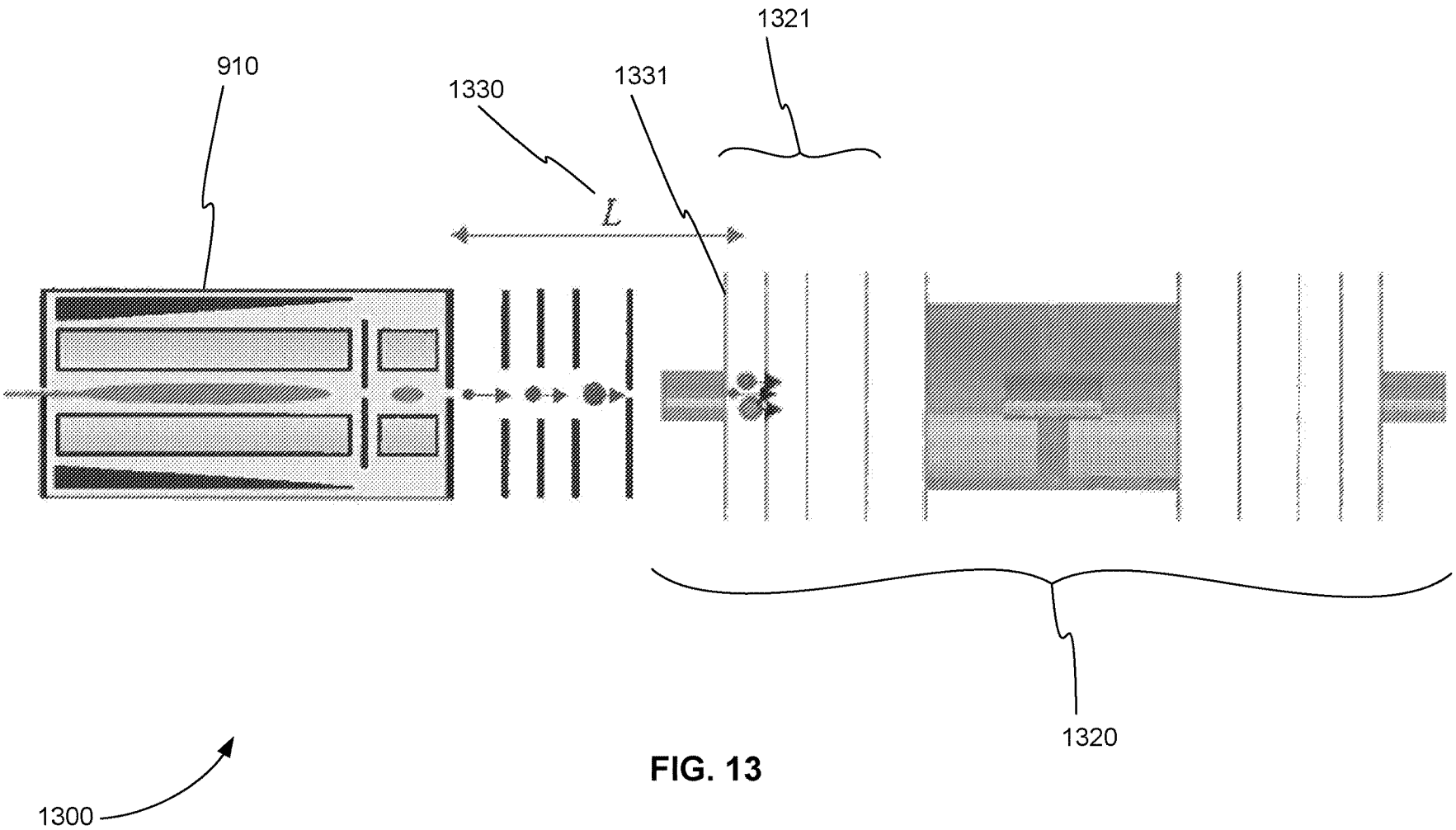
FIG. 13 is an exemplary side view of an ion guide sequentially injecting ions in order of decreasing m/z into a single detector ELIT showing the location of ion focus when mirror-switching of an ELIT reflectron plate is used to perform in-trap potential lift ion capture, in accordance with various embodiments.

FIG. 13 is an exemplary side view 1300 of an ion guide sequentially injecting ions in order of decreasing m/z into a single detector ELIT showing the location of ion focus when mirror-switching of an ELIT reflectron plate is used to perform in-trap potential lift ion capture, in accordance with various embodiments. In FIG. 13, ion guide 910 sequentially injects ions in order of decreasing m/z into ELIT 1320 and focuses the ions in the same location at the same time irrespective of m/z value using Zeno pulsing.

The capture action of mirror switching can be used to impart the trapped kinetic energy on all ions in an ELIT. In FIG. 13, for example, mirror switching of reflectron plate 1331 of first set of reflectron plates 1321 has the effect of performing in-trap potential-lift on the ions. This requires that ion guide 910 and Zeno injection focus a very narrow ion packet to minimize the kinetic energy distribution and ion losses at a location near reflectron plate 1331 and at length 1330 from ion guide 910. The in-trap potential-lift and trapping potentials of reflectron plate 1331 are likely unequal. Therefore, two different pulsed potentials would need to be applied to reflectron plate 1331; one to lift the potential energy of the ions and accelerate them into the ELIT, as depicted in FIG. 13, and one to increase the repulsive potential of the electrode once ions enter the ELIT and are not in the vicinity of the pulsed potential.

Figure 14:
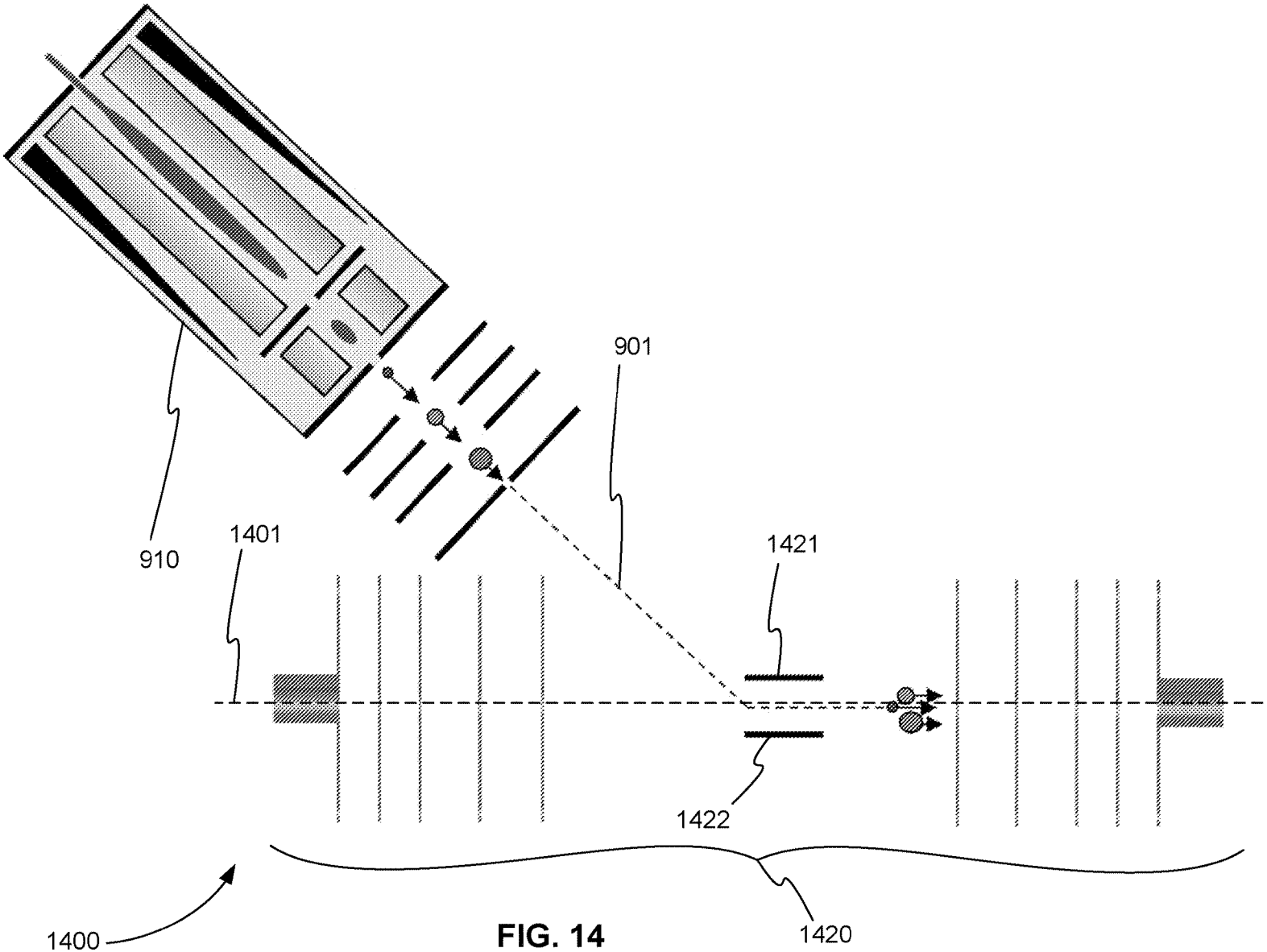
FIG. 14 is an exemplary side view of an ion guide positioned radially with respect to an ELIT to sequentially inject ions in order of decreasing m/z radially into the ELIT, in accordance with various embodiments.

FIG. 14 is an exemplary side view 1400 of an ion guide positioned radially with respect to an ELIT to sequentially inject ions in order of decreasing m/z radially into the ELIT, in accordance with various embodiments. In FIG. 14, ion guide 910 defines guide axis 901, and ELIT 1420 defines ELIT axis 1401. Ion guide 910 is positioned radially with respect to ELIT 1420 so that guide axis 901 intersects ELIT axis 1401 at an angle of less than ninety degrees at the location of ion focus on ELIT axis 1401.

Ion guide 910 sequentially injects ions in order of decreasing m/z along guide axis 901 and into ELIT 1420. Ion guide 910 focuses the ions at the intersection of guide axis 901 and ELIT axis 1401 at the same time irrespective of m/z value using Zeno pulsing.

In various embodiments, ions can be focused anywhere along ELIT axis 1401. For the purposes of FIG. 14, the pickup tube and detector of ELIT 1420 are not shown. Radial injection of ions into ELIT 1420 allows other mass spectrometry devices to be connected to the input or output of ELIT 1420. Deflection electrodes 1421 and 1422 are used to change the ion trajectory from guide axis 901 to ELIT axis 1401 by applying dissimilar potentials to the two electrodes. A non-repulsive potential is applied to deflection electrode 1421 and a repulsive potential is applied to deflection electrode 1422. Once ions pass through deflection electrodes 1421 and 1422, the potential of deflection electrode 1421 and deflection electrode 1422 are made to be equal, thereby capturing ions in ELIT 1420.

Figure 15:
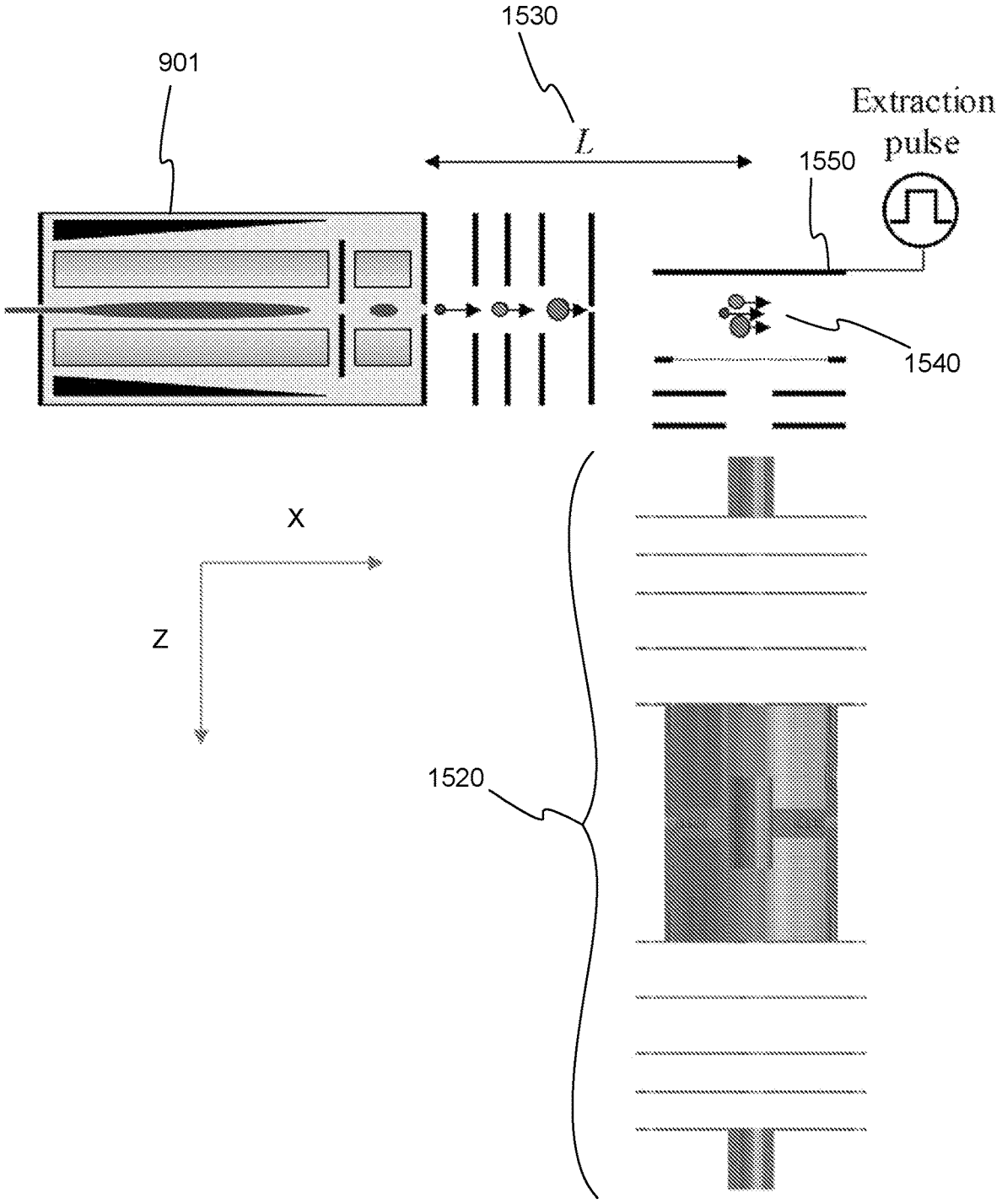
FIG. 15 is an exemplary side view of an ion guide positioned orthogonal to an ELIT to sequentially inject ions in order of decreasing m/z radially into an extraction region for orthogonal acceleration into an ELIT showing the location of ion focus, in accordance with various embodiments.

FIG. 15 is an exemplary side view 1500 of an ion guide positioned orthogonal to an ELIT to sequentially inject ions in order of decreasing m/z radially into an extraction region for orthogonal acceleration into an ELIT showing the location of ion focus, in accordance with various embodiments. As in the '388 Patent, ion guide 910 sequentially injects ions in order of decreasing m/z into extraction region 1540 and focuses the ions in the same location at the same time irrespective of m/z value using Zeno pulsing. The ions are focused at length 1530 from ion guide 910 in extraction region 1540.

In this case, the m/z is still maximized. However, there is still TOF separation between the extraction region 1540 and ELIT 1520, thereby making the dimensions of ELIT an important factor in determining the figures-of-merit for ELIT 1520. Additional focusing elements are also required to shape the ion beam, considering that the position distribution of the ion cloud would be widest in the X dimension within the accelerator 1550, while ELIT 1520 requires an ion packet that is oriented along the Z dimension.

System for Injecting Ions into an ELIT

Figure 16:
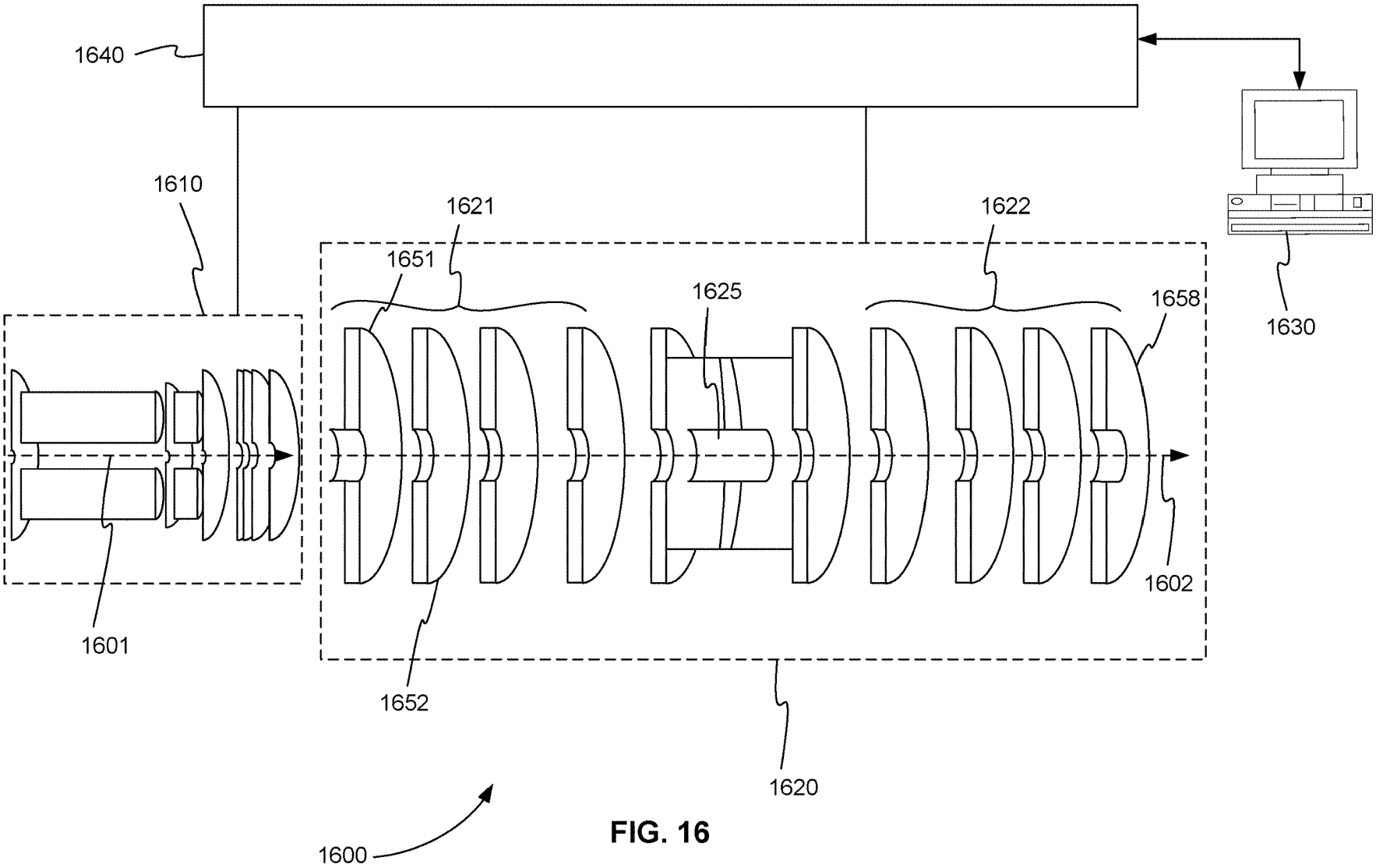
FIG. 16 is a schematic diagram of a system for sequentially injecting ions into an ELIT of a mass spectrometer so that ions with different m/z values are focused at the same location at the same time in the ELIT, in accordance with various embodiments.

FIG. 16 is a schematic diagram 1600 of a system for sequentially injecting ions into an ELIT of a mass spectrometer so that ions with different m/z values are focused at the same location at the same time in the ELIT, in accordance with various embodiments. The system of FIG. 16 includes ion guide 1610 and ELIT 1620.

ELIT 1620 includes pickup electrode 1625, first set of reflectron plates 1621, and second set of reflectron plates 1622. Each plate of first set of reflectron plates 1621 includes a hole in the center and is aligned along ELIT axis 1602. Each plate of second set of reflectron plates 1622 similarly includes a hole in the center and is aligned along ELIT axis 1602.

Ion guide 1610 defines guide axis 1601. Ion guide 1610 receives ions along guide axis 1601 from an ion beam of a mass spectrometer (not shown). Ion guide 1610 applies a potential profile that includes a pseudopotential well to the ions along guide axis 1601 using an ion control field. The ion control field includes a component for restraining movement of the ions normal to guide axis 1601 and a component for controlling the movement of the ions parallel to guide axis 1601. Finally, ion guide 1610 sequentially injects the ions into ELIT 1620 with the same ion energy and in order of m/z value to focus the ions irrespective of m/z value at the same location on ELIT axis 1602 within ELIT 1620 at the same time by varying the magnitude of the pseudopotential well.

Figure 17:
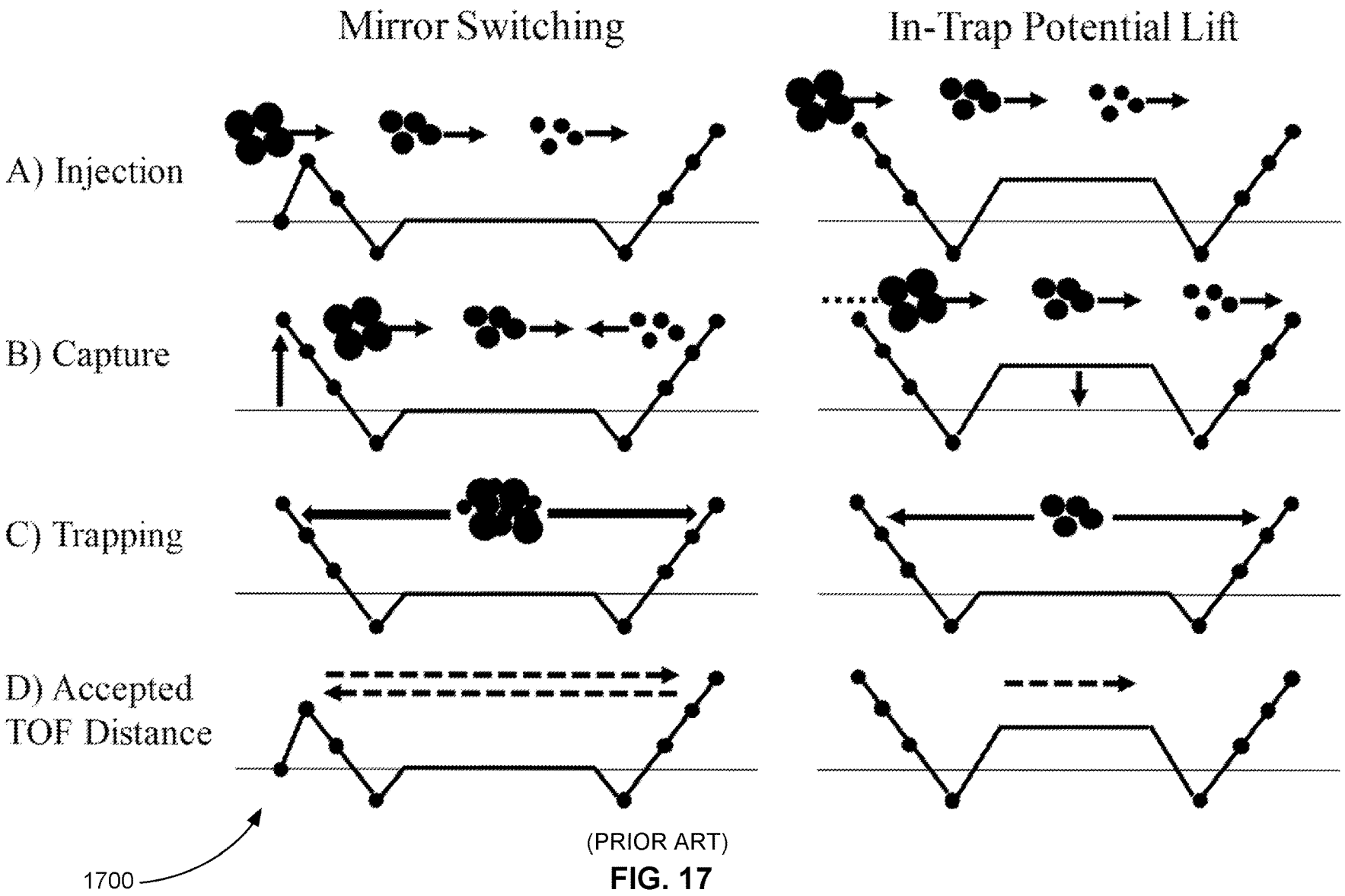
(PRIOR ART) FIG. 17
FIG. 17 is a series of diagrams showing the potentials applied across an ELIT during ion injection, capture, and trapping for mirror switching and in-trap potential-lift.

FIG. 17 is a series of diagrams 1700 showing the potentials applied across an ELIT during ion injection, capture, and trapping for mirror switching and in-trap potential-lift.

Returning to FIG. 16, in various embodiments, ELIT 1620 traps the ions along ELIT axis 1602 using in-trap potential-lift after the sequential injection into ELIT 1620 from ion guide 1610.

If ELIT 1620 is a single detector ELIT as shown in FIG. 16, then pickup electrode 1625 is also a lift electrode. Because in-trap potential-lift ion capture is used, the same location on ELIT axis 1602 is a location within a portion of the ELIT axis surrounded by the lift electrode (pickup electrode 1625). FIG. 16 is an example of a single detector ELIT, but is not the only configuration. It is possible to perform ion detection on the reflectron plate electrodes so that the tube is only used for in-trap potential-lift.

In various embodiments, as shown in FIG. 16, ion guide 1610 is positioned next to ELIT 1620 and on a side of first set of reflectron plates 1621 opposite the lift electrode (pickup electrode 1625). In various embodiments, guide axis 1601 and ELIT axis 1602 do not need to be coaxial, even in the case of sequential axial injection. Transfer lenses (not shown) between ion guide 1610 and ELIT 1620 can offset the ion beam by several millimeters in order to prevent gas carry-over. Or, ELIT 1620 can be radially offset and the transfer lenses include a pair of deflection electrodes.

Figure 18:
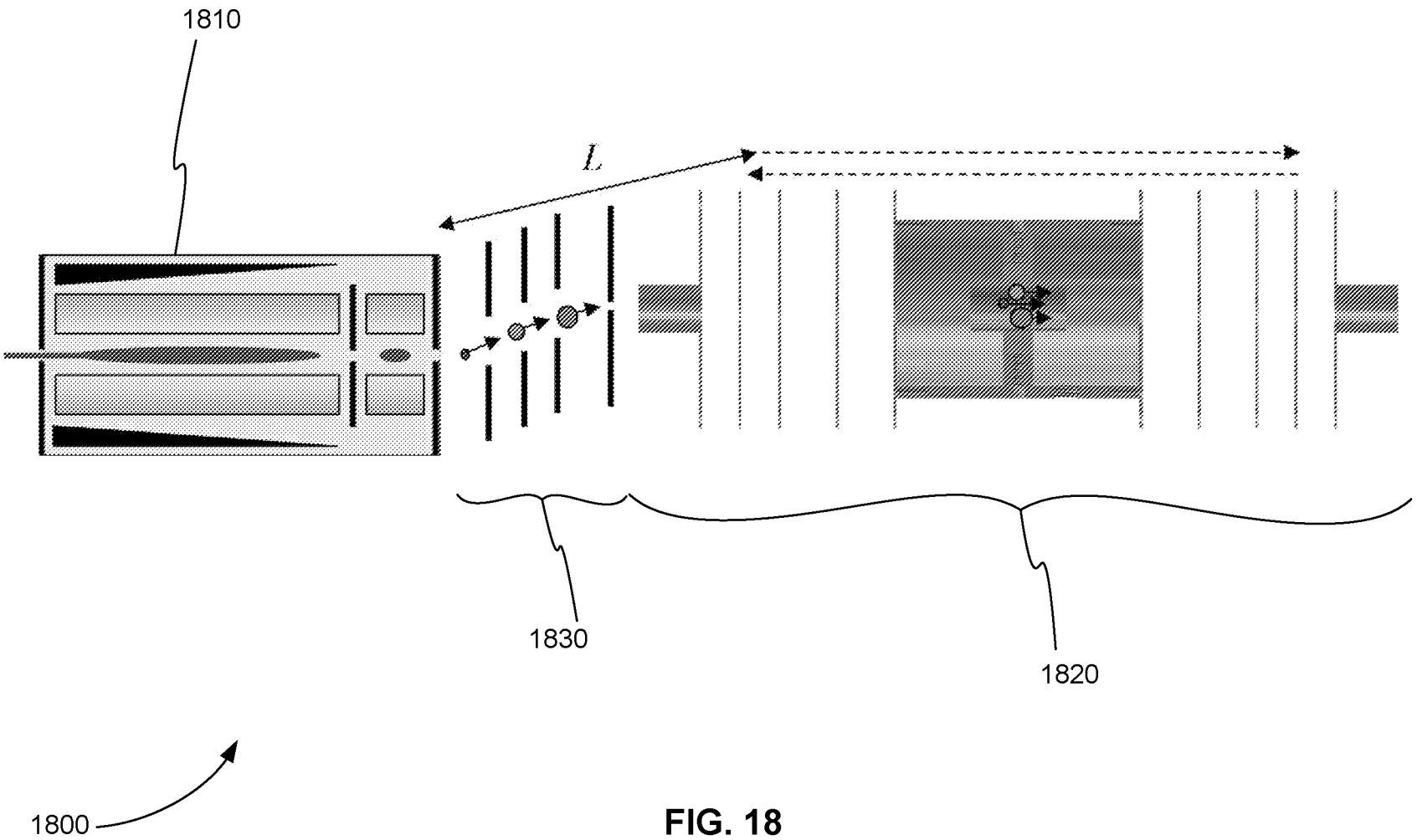
FIG. 18 is a schematic diagram showing that transfer lenses can be used to offset the ion beam between an ion guide and an ELIT, in accordance with various embodiments.

FIG. 18 is a schematic diagram 1800 showing that transfer lenses can be used to offset the ion beam between an ion guide and an ELIT, in accordance with various embodiments. In FIG. 18, transfer lenses 1830 offset the ion beam between ion guide 1810 and ELIT 1820.

Figure 19:
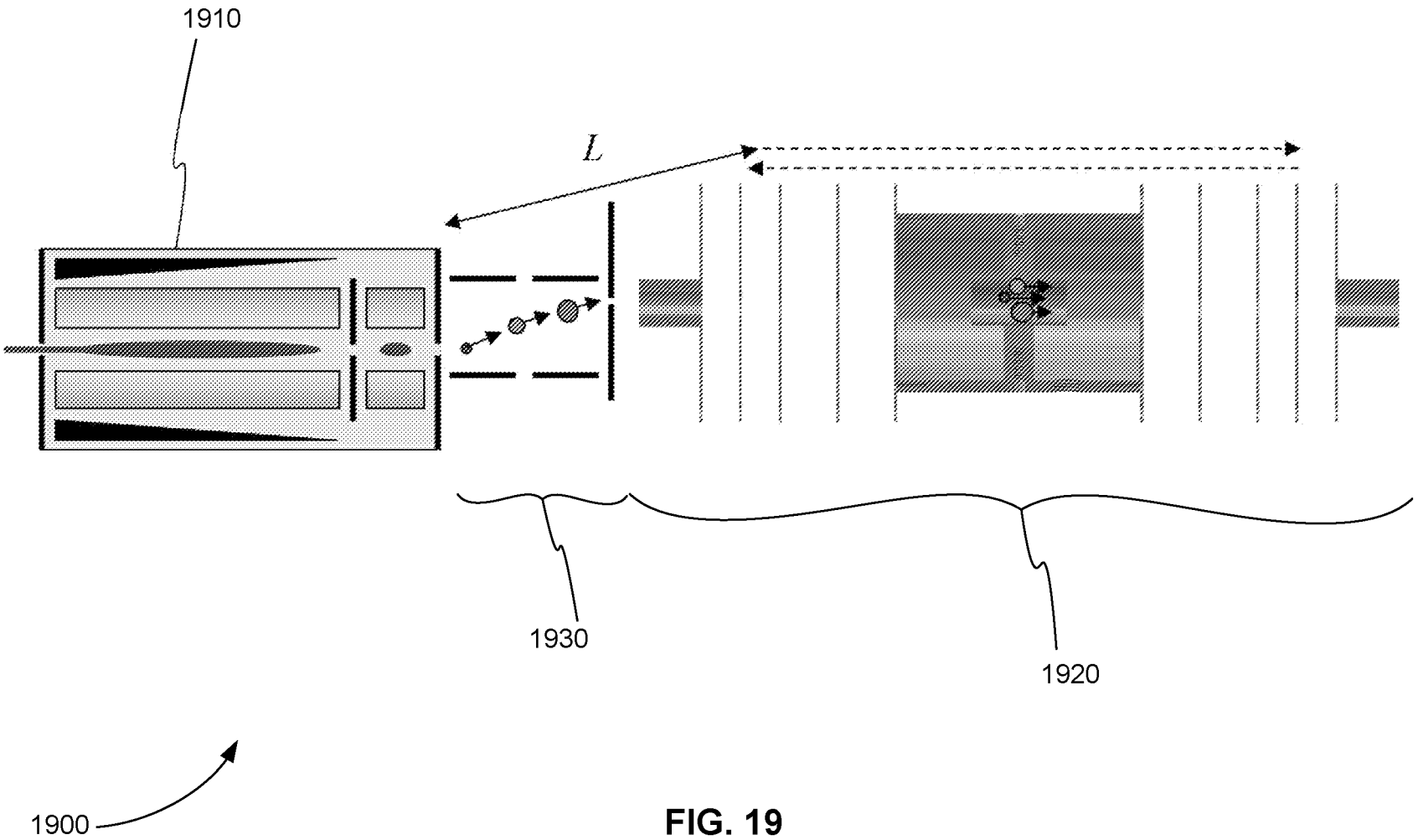
FIG. 19 is a schematic diagram showing that deflection electrodes can be used to offset the ion beam between an ion guide and an ELIT, in accordance with various embodiments.

FIG. 19 is a schematic diagram 1900 showing that deflection electrodes can be used to offset the ion beam between an ion guide and an ELIT, in accordance with various embodiments. In FIG. 19, deflection electrodes 1930 offset the ion beam between ion guide 1910 and ELIT 1920.

Figure 20:
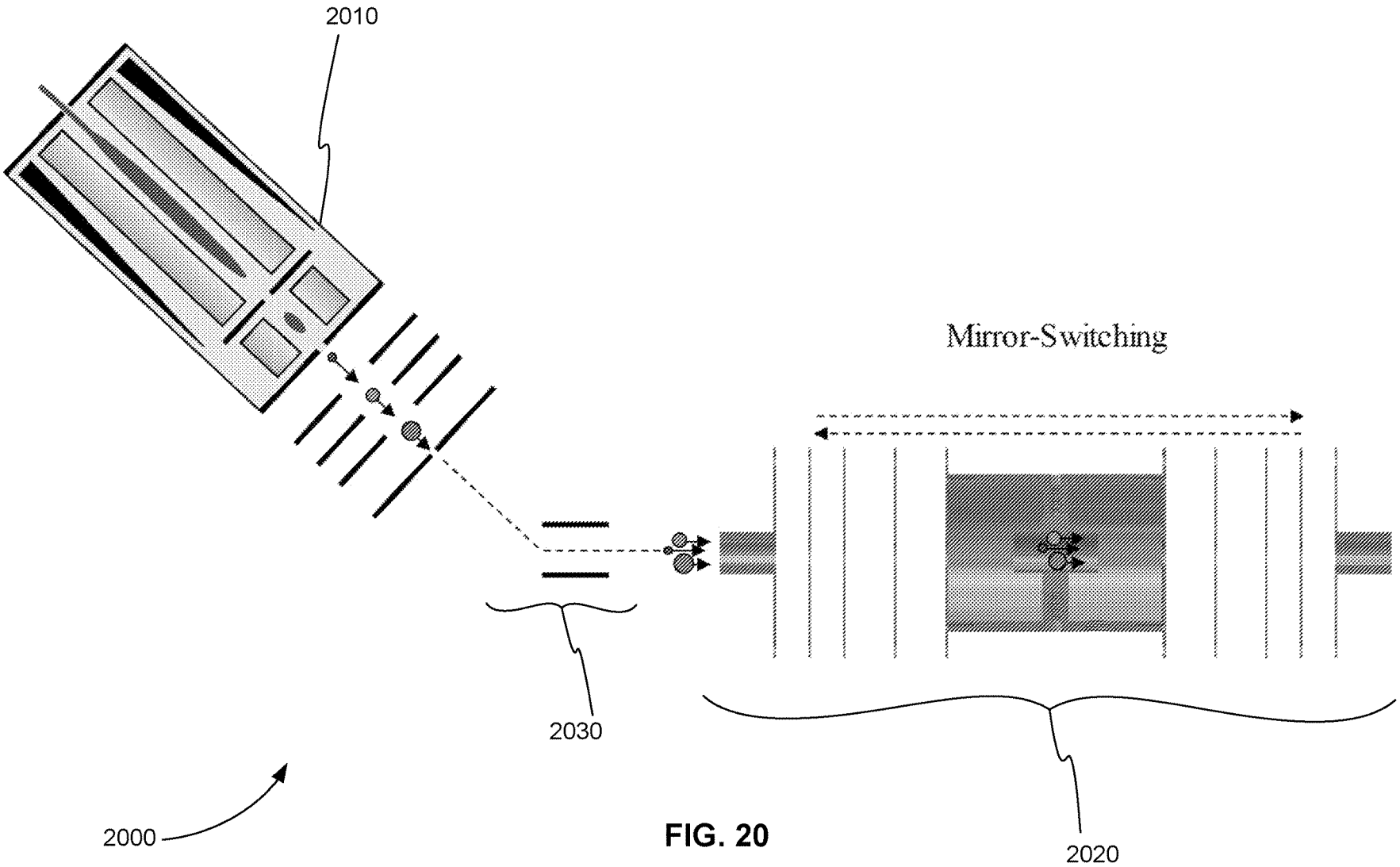
FIG. 20 is a schematic diagram showing that deflection electrodes can also be used to deflect the ion beam radially between an ion guide and an ELIT, in accordance with various embodiments.

FIG. 20 is a schematic diagram 2000 showing that deflection electrodes can also be used to deflect the ion beam radially between an ion guide and an ELIT, in accordance with various embodiments. In FIG. 20, deflection electrodes 2030 offset the ion beam between ion guide 2010 and ELIT 2020.

Returning to FIG. 16, during the sequential injection, a fixed potential is applied to first set of reflectron plates 1621, the lift electrode (pickup electrode 1625), and second set of reflectron plates 1622. The ions are sequentially injected into to ELIT 1620 from ion guide 1601 along ELIT axis 1602 and through the holes of first set of reflectron plates 1621. The ions are focused at the location within the portion of ELIT axis 1602 surrounded by the lift electrode (pickup electrode 1625) at the same time.

ELIT 1620 then traps the ions injected into ELIT 1620 by changing the potential applied to the lift electrode (pickup electrode 1625) that reduces the same ion energy of the ions such that they are unable to overcome the fixed potential barrier of first set of reflectron plates 1621 and second set of reflectron plates 1622. The ions are then trapped between outermost plates 1651 and 1658 of first set of reflectron plates 1621 and second set of reflectron plates 1622, respectively.

An ion guide positioned next to a single detector ELIT that performs in-trap potential-lift is also depict in FIG. 11.

Returning to FIG. 16, in various embodiments, ion guide 1610 can be positioned radially with respect to ELIT 1620 so that guide axis 1601 intersects ELIT axis 1602 at an angle of less than ninety degrees at the same location (focus location) on ELIT axis 1602. Again, during the sequential injection, a fixed potential is applied to first set of reflectron plates 1621, the lift electrode (pickup electrode 1625), and the second set of reflectron plates 1602. However, in this case, ions are sequentially injected into to ELIT 1620 from ion guide 1610 along guide axis 1601. The ions are focused at the location within the portion of ELIT axis 1602 surrounded by the lift electrode (pickup electrode 1625) at the same time. The focus location is also, for example, the intersection (not shown) of guide axis 1601 and the ELIT axis 1602.

In various embodiments, ions can be focused anywhere along ELIT axis 1401. Radial injection of ions into ELIT 1620 allows other mass spectrometry devices to be connected to the input or output of ELIT 1620. Deflection electrodes (not shown) are used to change the ion trajectory from guide axis 1601 to ELIT axis 1602 by applying dissimilar potentials to the two electrodes. A non-repulsive potential is applied to one deflection electrode and a repulsive potential is applied to the other deflection electrode. Once ions pass through the deflection electrodes, the potentials of both deflection electrodes are made to be equal, thereby capturing ions in ELIT 1620.

ELIT 1620 then traps ions in the same fashion as described above in the coaxial case. An ion guide positioned radially with respect to a single detector ELIT that can perform in-trap potential-lift ion capture is depicted in FIG. 14.

Returning to FIG. 16, in various embodiments, ELIT 1620 can be a multi-detector that performs in-trap potential-lift ion capture. ELIT 1620 further includes at least one lift electrode (not shown) positioned along ELIT axis 1602. In addition to pickup electrode 1625, ELIT further includes one or more additional pickup electrodes (not shown). The same location (focus location) on ELIT axis 1602 is also a location within a portion of ELIT axis 1602 surrounded by the lift electrode.

In various embodiments, ion guide 1610 is positioned on the side of first set of reflectron plates 1622 opposite pickup electrode 1625. During the sequential injection, ions are sequentially injected into ELIT 1620 from ion guide 1610 along ELIT axis 1602. The ions are focused at a location within the portion of ELIT axis 1602 surrounded by the at least one lift electrode at the same time.

A multi-detector ELIT traps the ions in the same fashion as a single detector ELIT that performs in-trap potential lift, as described above. An ion guide positioned next to a dual detector ELIT that can perform in-trap potential-lift is depicted in FIG. 10.

In various embodiments, an ion guide can also be positioned radially with respect to a multi-detector ELIT that performs in-trap potential lift. The multi-detector ELIT is positioned similarly to single detector 1420 of FIG. 14 and receives injected ions in a similar fashion to single detector 1420. Ions are then trapped in the dual detector ELIT in the same fashion as a single detector ELIT that performs in-trap potential lift, as described above.

Returning to FIG. 16, in various embodiments, ELIT 1620 traps the ions along ELIT axis 1602 using mirror-switching after the sequential injection into ELIT 1620 from ion guide 1610. During the sequential injection, a repulsive potential applied to outermost plate 1651 of first set of reflectron plates 1621 and outermost plate 1658 of second set of reflectron plates 1622 to repulse the ions from ion guide 1610 is changed to a non-repulsive potential at outermost plate 1651 of first set. The ions are sequentially injected into ELIT 1620 from ion guide 1610 along ELIT axis 1602 and through the holes of first set of reflectron plates 1621. The ions are focused at the same location on ELIT axis 1602 within ELIT 1620 at the same time. The same location on ELIT axis 1602 is a location between plate 1652 of first set of reflectron plates 1621 adjacent to outermost plate 1651 of first set of reflectron plates 1621 and outermost plate 1658 of second set of reflectron plates 1622. In various embodiments, the same location on ELIT axis 1602 is preferably a location within a portion of ELIT axis 1602 surrounded by pickup electrode 1625 (or the center of ELIT 1620).

ELIT 1620 traps the ions injected into ELIT 1620 by reapplying the repulsive potential to outermost plate 1651 of first set of reflectron plates 1621 so that the ions injected into ELIT 1620 are trapped between outermost plate 1651 of first set of reflectron plates 1621 and outermost plate 1658 of second set of reflectron plates 1622.

An ion guide positioned next to an ELIT that performs mirror-switching ion capture is also depicted in FIG. 12.

In various embodiments, an ion guide can be positioned radially with respect to an ELIT that performs mirror-switching ion capture. Returning to FIG. 16, ion guide 1610 can be positioned radially with respect to ELIT 1620 so that guide axis 1601 intersects ELIT axis 1602 at an angle of less than ninety degrees at the same location on ELIT axis 1602 within ELIT 1620.

During the sequential injection, the ions are sequentially injected along guide axis 1601 into ELIT 1620 from ion guide 1610 and focused at the same location on ELIT axis 1602 within ELIT 1620 at the same time. The same location on ELIT axis 1602, in this case, is a location between outermost plate 1651 of first set of reflectron plates 1621 and outermost plate 1658 of second set of reflectron plates 1622. In various embodiments, the same location on ELIT axis 1602 is preferably a location within a portion of ELIT axis 1602 surrounded by pickup electrode 1625 (or the center of ELIT 1620).

ELIT 1620 traps the ions injected into ELIT 1620 by applying a repulsive potential to outermost plate 1651 of first set of reflectron plates 1621 and outermost plate 1658 of second set of reflectron plates 1622 that traps the ions injected from ion guide 1610 between outermost plate 1651 of first set of reflectron plates 1621 and outermost plate 1658 of second set of reflectron plates 1622.

An ion guide positioned radially with respect to a single detector ELIT that can perform mirror-switching ion capture is depicted in FIG. 14.

In various embodiments, the system of FIG. 16 further includes one or more voltage sources 1640. The one or more voltage sources 1640 apply different voltages to one or more electrodes of ELIT 1620 and ion guide 1610.

In various embodiments, processor 1630 is used to control or provide instructions to ion guide 1610 and ELIT 1620 and to analyze data collected. Processor 1630 controls or provides instructions by, for example, controlling one or more voltage sources 1640. Processor 1630 can also control one or more current or pressure sources (not shown). Alternatively, processor 1630 can directly apply currents or voltages. Processor 1630 can be a separate device as shown in FIG. 16 or can be a processor or controller of one or more devices of a mass spectrometer (not shown). Processor 1630 can be, but is not limited to, a controller, a computer, a microprocessor, the computer system of FIG. 1, or any device capable of sending and receiving control signals and data.

Method for Injecting Ions into an ELIT

Figure 21:
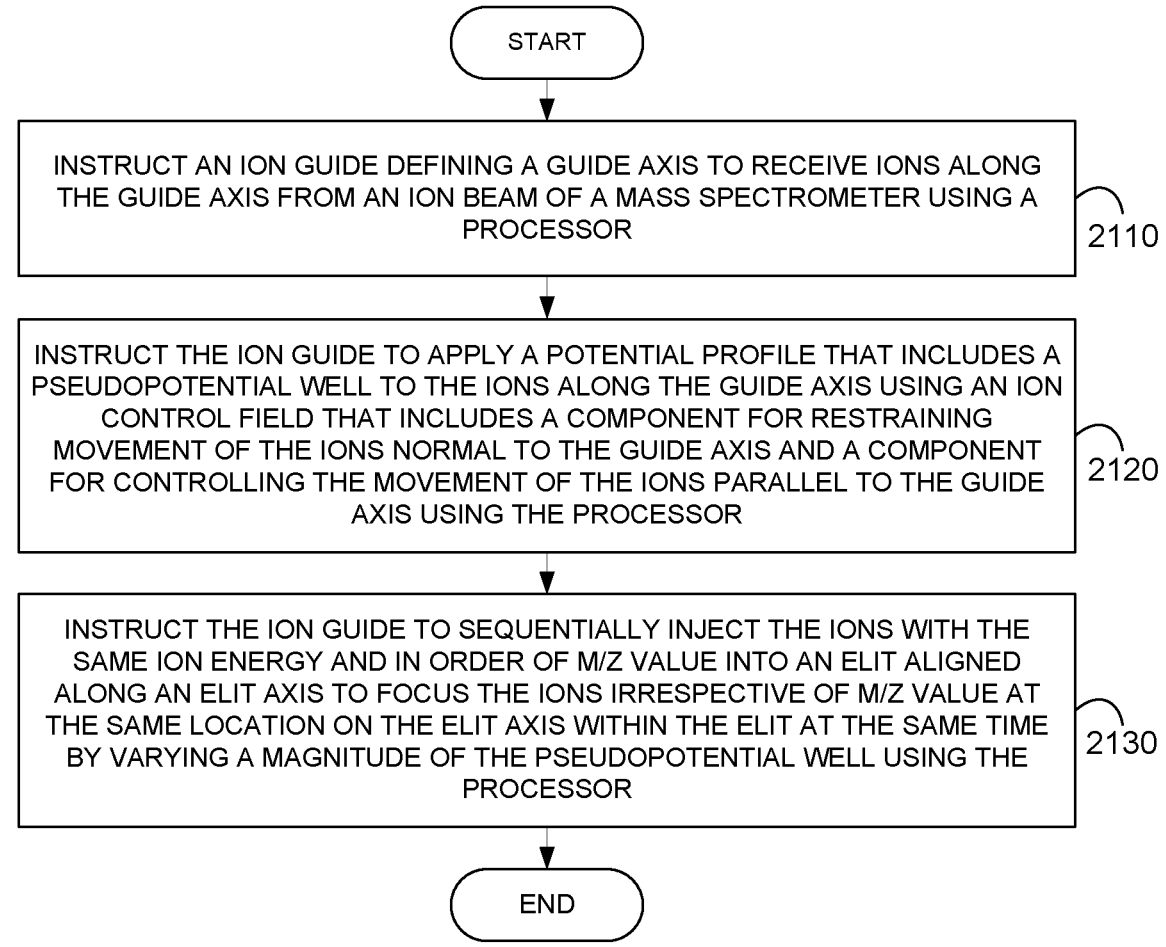
FIG. 21 is a flowchart showing a method for sequentially injecting ions into an ELIT of a mass spectrometer so that ions with different m/z values are focused at the same location at the same time in the ELIT, in accordance with various embodiments.

FIG. 21 is a flowchart showing a method 2100 for sequentially injecting ions into an ELIT of a mass spectrometer so that ions with different m/z values are focused at the same location at the same time in the ELIT, in accordance with various embodiments.

In step 2110 of method 2100, an ion guide defining a guide axis is instructed to receive ions along the guide axis from an ion beam of a mass spectrometer using a processor.

In step 2120, the ion guide is instructed to apply a potential profile that includes a pseudopotential well to the ions along the guide axis using an ion control field that includes a component for restraining movement of the ions normal to the guide axis and a component for controlling the movement of the ions parallel to the guide axis using the processor.

In step 2130, the ion guide is instructed to sequentially inject the ions with the same ion energy and in order of m/z value into an ELIT aligned along an ELIT axis to focus the ions irrespective of m/z value at the same location on the ELIT axis within the ELIT at the same time by varying a magnitude of the pseudopotential well using the processor.

Computer Program Product for Injecting Ions into an ELIT

In various embodiments, computer program products include a tangible computer-readable storage medium whose contents include a program with instructions being executed on a processor so as to perform a method a method for sequentially injecting ions into an ELIT of a mass spectrometer so that ions with different m/z values are focused at the same location at the same time in the ELIT. This method is performed by a system that includes one or more distinct software modules.

Figure 22:
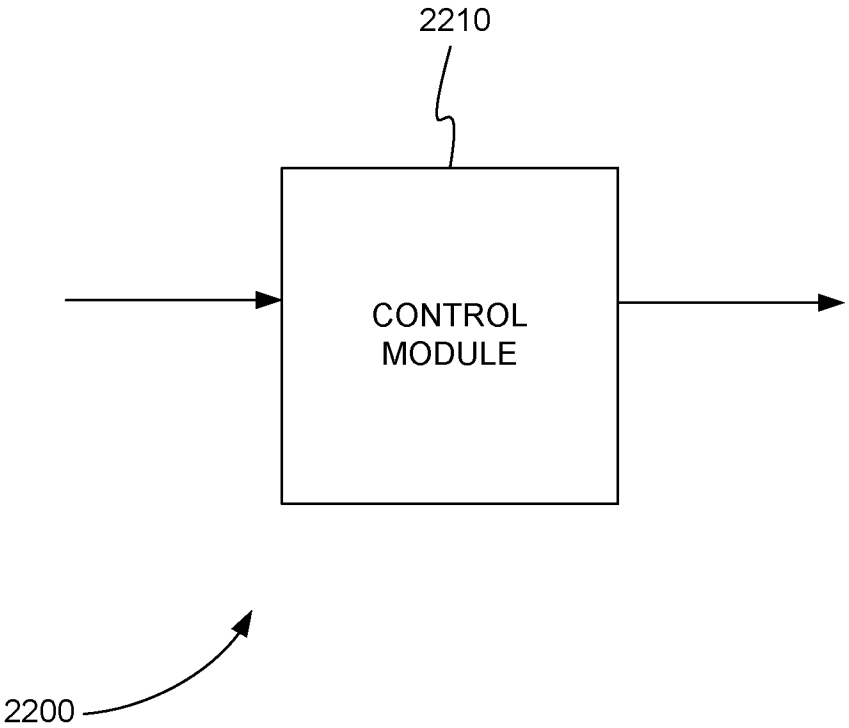
FIG. 22 is a schematic diagram of a system that includes one or more distinct software modules that perform a method a method for sequentially injecting ions into an ELIT of a mass spectrometer so that ions with different m/z values are focused at the same location at the same time in the ELIT, in accordance with various embodiments.

FIG. 22 is a schematic diagram of a system 2200 that includes one or more distinct software modules that perform a method a method for sequentially injecting ions into an ELIT of a mass spectrometer so that ions with different m/z values are focused at the same location at the same time in the ELIT, in accordance with various embodiments. System 2200 includes a control module 2210.

Control module 2210 instructs an ion guide defining a guide axis to receive ions along the guide axis from an ion beam of a mass spectrometer. Control module 2210 instructs the ion guide to apply a potential profile that includes a pseudopotential well to the ions along the guide axis using an ion control field. The ion control field includes a component for restraining movement of the ions normal to the guide axis and a component for controlling the movement of the ions parallel to the guide axis. Control module 2210 instructs the ion guide to sequentially inject the ions with the same ion energy and in order of m/z value into an ELIT aligned along an ELIT axis to focus the ions irrespective of m/z value at the same location on the ELIT axis within the ELIT at the same time by varying a magnitude of the pseudopotential well.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for sequentially injecting ions into an electrostatic linear ion trap (ELIT) of a mass spectrometer so that ions with different mass-to-charge ratio (m/z) values are focused at a same location at a same time in the ELIT, comprising:

an ELIT that includes a first set of reflectron plates with holes in the center that is aligned along an ELIT axis and a second set of reflection plates with holes in the center that is aligned along the ELIT axis; and an ion guide defining a guide axis that receives ions along the guide axis from an ion beam of a mass spectrometer, applies a potential profile that includes a pseudopotential well to the ions along the guide axis using an ion control field that includes a component for restraining movement of the ions normal to the guide axis and a component for controlling the movement of the ions parallel to the guide axis, and sequentially injects the ions into the ELIT with a same ion energy and in order of m/z value to focus the ions irrespective of m/z value at a same location on the ELIT axis within the ELIT at a same time by varying a magnitude of the pseudopotential well.

2. The system of claim 1, wherein the ELIT traps the ions along the ELIT axis using in-trap potential-lift after the sequential injection into the ELIT from the ion guide.

3. The system of claim 2, wherein the ELIT is a single detector ELIT and wherein the same location on the ELIT axis within the ELIT comprises a location within a portion of the ELIT axis surrounded by a lift electrode.

4. The system of claim 3, wherein the ion guide is positioned on a side of the first set of reflectron plates opposite the lift electrode, wherein, during the sequential injection, a fixed potential is applied to the first set of reflectron plates, the lift electrode, and the second set of reflectron plates, the ions are sequentially injected into the ELIT from the ion guide along the ELIT axis and through the holes of the first set of reflectron plates, and the ions are focused at the location within the portion of the ELIT axis surrounded by the lift electrode at the same time, and wherein the ELIT traps the ions injected into the ELIT by applying a potential to the lift electrode that reduces the same ion energy of the ions low enough to be unable to overcome the fixed potential of the first set of reflectron plates and the second set of reflectron plates and trapping the ions between the outermost plates of the first set and the second set.

5. The system of claim 3, wherein the ion guide is positioned radially with respect to the ELIT so that the guide axis intersects the ELIT axis at an angle of less than ninety degrees at the same location on the ELIT axis, wherein two or more deflection electrodes are used to change the ion trajectory from the guide axis to the ELIT axis by applying dissimilar potentials to the two or more deflection electrodes, a non-repulsive potential is applied to at least one deflection electrode and a repulsive potential is applied to at least one other deflection electrode, and, once ions pass through d the two or more deflection electrodes, the potential of at least one deflection electrode and the at least one other deflection electrode are made to be equal, wherein, during the sequential injection, a fixed potential is applied to the first set of reflectron plates, the lift electrode, and the second set of reflectron plates, the ions are sequentially injected into the ELIT from the ion guide along the guide axis, and the ions are focused at the location within the portion of the ELIT axis surrounded by the lift electrode at the same time, and wherein the ELIT traps the ions injected into the ELIT by applying a potential to the lift electrode that reduces the same ion energy of the ions low enough to be unable to overcome the fixed potential of the first set of reflectron plates and the second set of reflectron plates and trapping the ions between the outermost plates of the first set and the second set.

6. The system of claim 2, wherein the ELIT is a multi-detector ELIT, wherein the ELIT further includes at least one lift electrode and two or more pickup electrodes positioned along the ELIT axis and wherein the same location on the ELIT axis within the ELIT comprises a location within a portion of the ELIT axis surrounded by the lift electrode.

7. The system of claim 6, wherein the ion guide is positioned on a side of the first set of reflectron plates, wherein, during the sequential injection, a fixed potential is applied to the first set of reflectron plates, the lift electrode, and the second set of reflectron plates, the ions are sequentially injected into the ELIT from the ion guide along the ELIT axis, through the holes of the first set of reflectron plates, and the ions are focused at the location within the portion of the ELIT axis surrounded by the lift electrode at the same time, and wherein the ELIT traps the ions injected into the ELIT by applying a potential to the lift electrode that reduces the same ion energy of the ions low enough to be unable to overcome the fixed potential of the first set of reflectron plates and the second set of reflectron plates and trapping the ions between the outermost plates of the first set and the second set.

8. The system of claim 6, wherein the ion guide is positioned radially with respect to the ELIT so that the guide axis intersects the ELIT axis at an angle of less than ninety degrees at the same location on the ELIT axis, wherein two or more deflection electrodes are used to change the ion trajectory from the guide axis to the ELIT axis by applying dissimilar potentials to the two or more deflection electrodes, a non-repulsive potential is applied to at least one deflection electrode and a repulsive potential is applied to at least one other deflection electrode, and, once ions pass through d the two or more deflection electrodes, the potential of at least one deflection electrode and the at least one other deflection electrode are made to be equal, wherein, during the sequential injection, a fixed potential is applied to the first set of reflectron plates, the lift electrode, and the second set of reflectron plates, the ions are sequentially injected into the ELIT from the ion guide along the guide axis, and the ions are focused at the location within the portion of the ELIT axis surrounded by the lift electrode at the same time, and wherein the ELIT traps the ions injected into the ELIT by applying a potential to the lift electrode that reduces the same ion energy of the ions low enough to be unable to overcome the fixed potential of the first set of reflectron plates and the second set of reflectron plates and trapping the ions between the outermost plates of the first set and the second set.

9. The system of claim 1, wherein the ELIT traps the ions along the ELIT axis using mirror-switching after the sequential injection into the ELIT from the ion guide.

10. The system of claim 9, wherein the ion guide is positioned on a side of the first set of reflectron plates, wherein, during the sequential injection, a repulsive potential applied to an outermost plate of the first set of reflectron plates and an outermost plate of the second set of reflectron plates to repulse the ions from the ion guide is changed to a non-repulsive potential at the outermost plate of the first set, the ions are sequentially injected into the ELIT from the ion guide along the ELIT axis and through the holes of the first set of reflectron plates, and the ions are focused at the same location on the ELIT axis within the ELIT at the same time, wherein the same location on the ELIT axis comprises a location between a plate of the first set adjacent to the outermost plate of the first set and the outermost plate of the second set, and wherein the ELIT traps the ions injected into the ELIT by reapplying the repulsive potential to the outermost plate of the first set of reflectron plates so that the ions injected into the ELIT are trapped between the outermost plate of first set and the outermost plate of the second set.

11. The system of claim 10, wherein the location between a plate of the first set of reflectron plates adjacent to the outermost plate of the first set of reflectron plates and the outermost plate of the second set of reflectron plates comprises a location within a portion of the ELIT axis surrounded by a pickup electrode.

12. The system of claim 9, wherein the ion guide is positioned radially with respect to the ELIT so that the guide axis intersects the ELIT axis at an angle of less than ninety degrees at the same location on the ELIT axis within the ELIT, wherein two or more deflection electrodes are used to change the ion trajectory from the guide axis to the ELIT axis by applying dissimilar potentials to the two or more deflection electrodes, a non-repulsive potential is applied to at least one deflection electrode and a repulsive potential is applied to at least one other deflection electrode, and, once ions pass through d the two or more deflection electrodes, the potential of at least one deflection electrode and the at least one other deflection electrode are made to be equal, wherein, during the sequential injection, the ions are sequentially injected along the guide axis into the ELIT from the ion guide and focused at the same location on the ELIT axis within the ELIT at the same time, wherein the same location on the ELIT axis within the ELIT comprises a location between the outermost plate of the first set of reflectron plates and the outermost plate of the second set of reflectron plates, and wherein the ELIT traps the ions injected into the ELIT by applying a repulsive potential to an outermost plate of the first set and an outermost plate of the second set that traps the ions injected from the ion guide between the outermost plates of the first set and the second set.

13. The system of claim 12, wherein the location between the outermost plate of the first set of reflectron plates and the outermost plate of the second set of reflectron plates comprises a location within a portion of the ELIT axis surrounded by a pickup electrode.

14. A method for sequentially injecting ions into an electrostatic linear ion trap (ELIT) of a mass spectrometer so that ions with different mass-to-charge ratio (m/z) values are focused at a same location at a same time in the ELIT, comprising:

instructing an ion guide defining a guide axis to receive ions along the guide axis from an ion beam of a mass spectrometer using a processor;

instructing the ion guide to apply a potential profile that includes a pseudopotential well to the ions along the guide axis using an ion control field that includes a component for restraining movement of the ions normal to the guide axis and a component for controlling the movement of the ions parallel to the guide axis using the processor, and instructing the ion guide to sequentially inject the ions with a same ion energy and in order of m/z value into an ELIT aligned along an ELIT axis to focus the ions irrespective of m/z value at a same location on the ELIT axis within the ELIT at a same time by varying a magnitude of the pseudopotential well using the processor.

15. A computer program product, comprising a non-transitory and tangible computer-readable storage medium whose contents include a program with instructions being executed on a processor to perform a method for sequentially injecting ions into an electrostatic linear ion trap (ELIT) of a mass spectrometer so that ions with different mass-to-charge ratio (m/z) values are focused at a same location at a same time in the ELIT, comprising:

providing a system, wherein the system comprises one or more distinct software modules, and wherein the distinct software modules comprise a control module;

instructing an ion guide defining a guide axis to receive ions along the guide axis from an ion beam of a mass spectrometer using the control module;

instructing the ion guide to apply a potential profile that includes a pseudopotential well to the ions along the guide axis using an ion control field that includes a component for restraining movement of the ions normal to the guide axis and a component for controlling the movement of the ions parallel to the guide axis using the control module, and instructing the ion guide to sequentially inject the ions with a same ion energy and in order of m/z value into an ELIT aligned along an ELIT axis to focus the ions irrespective of m/z value at a same location on the ELIT axis within the ELIT at a same time by varying a magnitude of the pseudopotential well using the control module.

* * * * *